US006176059B1

(12) United States Patent
Cantarano et al.

(10) Patent No.: US 6,176,059 B1
(45) Date of Patent: Jan. 23, 2001

(54) MODULAR CONCRETE BUILDING SYSTEM

(76) Inventors: Robert A. Cantarano, 2013 Commonwealth Ave., 2F, Brighton, MA (US) 02135; Peter Fleischhacker, Rte. 140 - P.O. Box 96, Gilmanton-I.W., NH (US) 03837

( * ) Notice: Under 35 U.S.C. 154(b), the term of this patent shall be extended for 0 days.

(21) Appl. No.: 09/313,296

(22) Filed: May 17, 1999

Related U.S. Application Data

(63) Continuation of application No. 09/197,065, filed on Nov. 20, 1998, now abandoned.

(51) Int. Cl.[7] ..... E04B 2/32

(52) U.S. Cl. ..... 52/578; 52/563; 52/564; 52/562; 52/570; 52/415; 52/424; 52/426; 52/442; 52/589.1; 52/590.2; 52/591.2; 52/592.1

(58) Field of Search ..... 52/561, 562, 563, 52/564, 570, 415, 419, 424, 425, 426, 442, 590.2, 589.1, 591.1, 591.2, 578, 591.3, 591.4, 427, 592.1

(56) References Cited

U.S. PATENT DOCUMENTS

| | | | | |
|---|---|---|---|---|
| 1,258,839 | * | 3/1918 | Wheeler | 52/20 |
| 1,318,463 | * | 10/1919 | Scharwath | 252/62 |
| 1,350,490 | * | 8/1920 | Dyer | 52/591.1 |
| 1,405,574 | * | 2/1922 | Ferguson | 52/570 |
| 1,444,554 | * | 2/1923 | Quillet | 52/591.1 |
| 1,507,831 | * | 9/1924 | Hatch | 52/564 |
| 1,710,257 | * | 4/1929 | Haniman | 110/336 |
| 1,892,605 | * | 12/1932 | Betzler | 52/293.2 |
| 4,706,429 | * | 11/1987 | Young | 52/309.12 |
| 4,884,382 | * | 12/1989 | Horobin | 52/426 |
| 4,889,310 | * | 12/1989 | Boeshart | 249/41 |
| 5,351,455 | * | 10/1994 | Schoonover et al. | 52/410 |
| 5,428,933 | * | 7/1995 | Philippe | 52/592.1 |
| 5,459,971 | * | 10/1995 | Sparkman | 52/426 |
| 5,566,518 | * | 10/1996 | Martin et al. | 52/426 |
| 5,749,196 | * | 5/1998 | Bangma | 52/561 |
| 5,819,489 | * | 10/1998 | McKinney | 52/435 |
| 5,845,448 | * | 12/1998 | Potvin | 52/563 |
| 5,852,907 | * | 12/1998 | Tobin et al. | 52/714 |
| 5,890,337 | * | 4/1999 | Boeshart | 52/426 |

* cited by examiner

*Primary Examiner*—Christopher T. Kent
*Assistant Examiner*—Jennifer I. Thissell
(74) *Attorney, Agent, or Firm*—Morse, Altman & Martin

(57) ABSTRACT

A modular construction system and method of use for creating a concrete wall system which has a wall system which complies with a modular construction system. The system uses wall form panels having connectors and structural tie plates. The wall form panels have interlocking protrusions around the edges such that the panel is reversibly symmetric. The panels are specific lengths to minimize the number of panels required to achieve a set length. The structural tie plates have connectors to tie in with the wall form panels and in addition carry and position reinforcement bars with the wall. The modular wall system ensures ease and integrity of alignment of the wall form panels by the self-aligning structural tie elements. In a preferred embodiment, a footing is continuously integral with the wall. A heat retention cap form allows for a more uniform cure temperature in adverse temperatures. The modular system in addition allows for integrated tie-ins to built-out piers, which can support stone or steel or wood or poured concrete or continue as a vertical pier with design vertical reinforcement bar strength.

54 Claims, 42 Drawing Sheets

MODULAR CONCRETE BUILDING SYSTEM

RELATED APPLICATION(S)

This application is a continuation of U.S. Ser. No. 09/197,065 filed on Nov. 20, 1998, now abandoned the entire teachings of which are incorporated herein by reference.

BACKGROUND OF THE INVENTION

This invention relates to a system of components and a method of use for creating a concrete wall system.

Conventional foundations and above-ground masonry are typically built of poured concrete or stacked cinder or concrete block. These two types of construction, poured concrete and block, are used additionally for walls in commercial buildings, such as warehouses and hotels, and in residential homes. In preparing concrete walls for either foundations or structural walls, a support element is needed to retain the concrete while it hardens. The support element conventionally takes the form of wooden form boards and steel bracing to retain the concrete wall as it hardens. Additional bracing is required to hold the form boards and to align them appropriately. The form boards for holding the concrete are found in typical standard or nominal lengths and must be combined side-by-side, to achieve the desired length. While the panels (form board) on the outside can extend beyond the desired length, those form boards which retain the inner wall of the foundation need to be adjusted or fitted by cutting the form boards, so as not to interfere with adjacent walls being poured concurrently. In addition, the forms need to be removed from the site once the concrete hardens.

Cinder or concrete block hold advantages over poured concrete in that there is no need to bring forms onto the site and then remove them. However, the use of concrete or cinder blocks to form a wall is not a feasible alternative to concrete foundations where design strength or a building code is an issue. One additional shortcoming is that cinder or concrete block conventionally comes in limited fixed dimensions with no variable capability, such as cinder block is 16"×8"×8" and must be cut to create the foundation or wall of proper length.

It is recognized that the use of reinforcing bars or rebars within the hollows of the concrete blocks or within the foundation to which the concrete is poured does help to increase the strength of the resulting structure. However, in both instances there is a lengthy time element to position and properly secure the reinforcing bar prior to pouring the concrete or positioning the bar in the opening of the blocks, before adding concrete in the hollows of the cinder or concrete blocks.

Regardless of whether poured concrete or cinder or concrete block is used for a foundation, a footing is required below the wall. In both instances, a concrete footing needs to be prepared prior to creating the foundation wall.

SUMMARY OF THE INVENTION

This invention relates to a modular construction system and method of use for creating a concrete wall system. It is recognized that it is desired to have a wall system which complies with a modular construction system.

The system uses wall form panels having connectors and structural tie plates. The wall form panels have interlocking protrusions around the edges such that the panel is reversibly symmetric. The panels are specific lengths to minimize the number of panels required to achieve a set length. The structural tie plates have connectors to tie in with the wall form panels and in addition carry and position reinforcement bars with the wall. The modular wall system ensures ease and integrity of alignment of the wall form panels by the self-aligning structural tie elements.

In a preferred embodiment, a footing is continuously integral with the wall. A heat retention cap form allows for a more uniform cure temperature in adverse temperatures. The modular system in addition allows for integrated tie-ins to built-out piers, which can support stone or steel or wood or poured concrete or continue as a vertical pier with design vertical reinforcement bar strength.

This invention recognizes that the prior method of pouring a footing as a separate entity from the wall structure both creates an added expense and delay in time, as well as a structural discontinuity. The invention forms a continuous integral footing with the wall to overcome these problems.

The invention in addition recognizes that the pouring of concrete requires certain temperatures to ensure proper curing. The invention allows for a more uniform cure temperature by use of the forms, from footing forms to a heat retention cap form.

In addition, the modular system allows for integrated tie-ins to built-out piers, which can support stone, steel, wood, or poured concrete or continue as a vertical pier with design vertical reinforcement bar strength.

Another improvement of the modular wall systems is the ease and integrity of alignment of the components by the self-aligning structural elements.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
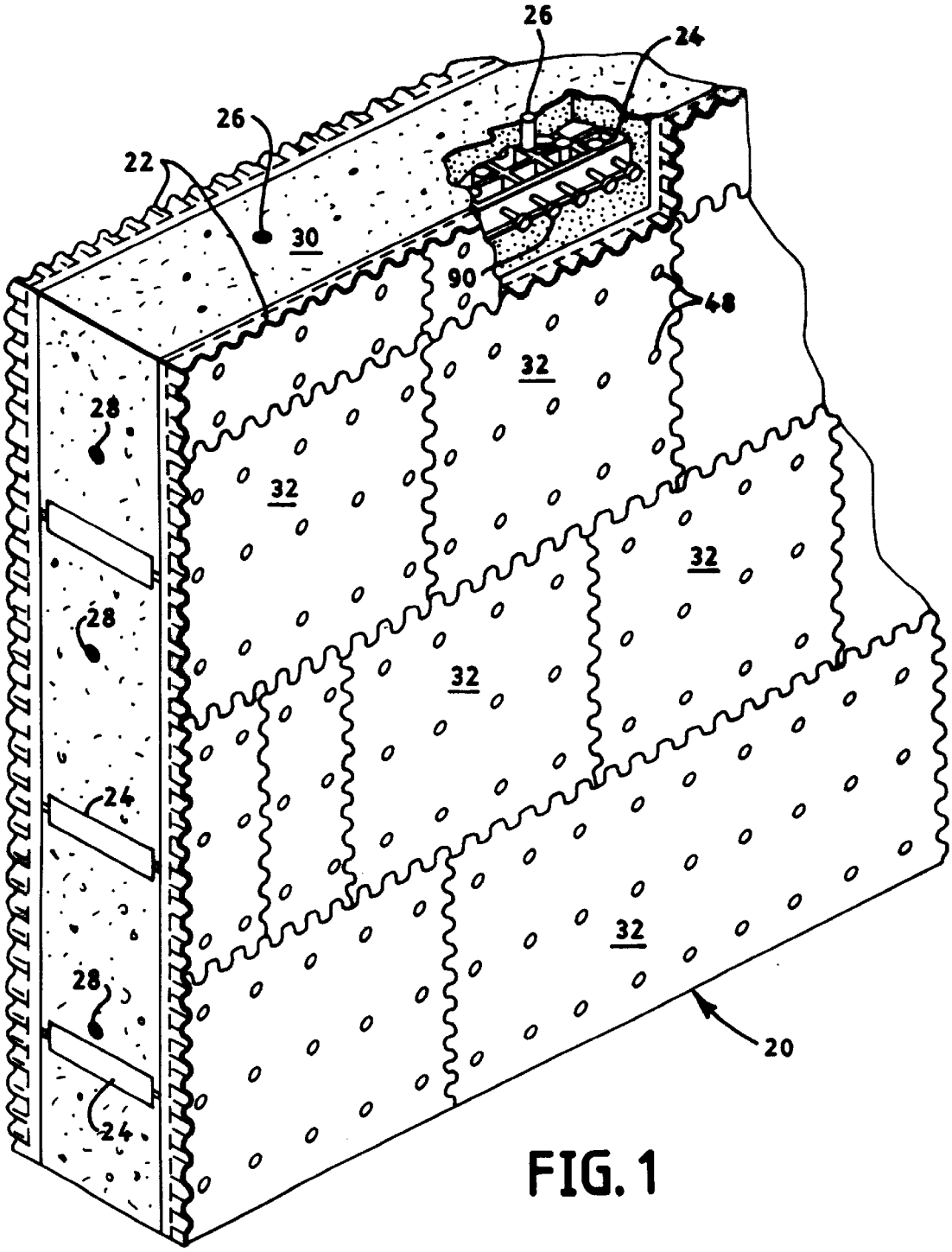
FIG. 1 is a perspective view of a concrete wall with a portion broken away.

Referring to the drawings in detail, wherein like numerals indicate like elements, there is illustrated a modular concrete wall system in accordance with the present invention, generally referred to as 20 in FIG. 1.

Referring to FIG. 1, the modular concrete wall system 20 has a pair of modular form walls 22, a plurality of structural tie plates 24, a plurality of vertical reinforcement bars or rebar 26, a plurality of horizontal reinforcement bars or rebar 28, and concrete 30. Each of the modular form walls 22 are created from a plurality of interlocking forms 32, also referred to as wall form panels. (The wall form panels 32 do not show both sets of protrusion, dimples or texture, for clarity those featured are explained below.) The pair of modular form walls 22 are connected and aligned by the plurality of structural tie plates 24. The vertical rebar 26 and the horizontal rebar 28 are connected and extend between the structural tie plates 24. The bottom horizontal reinforcement bar 28 is shown resting on the structural tie plate 24, the other horizontal reinforcement bars 28 are resting on other structural tie plates 24, not seen. The concrete 30 is poured between the modular forms 22 and encases the structural tie plates 24, and the rebars 26 and 28.

Figure 2:
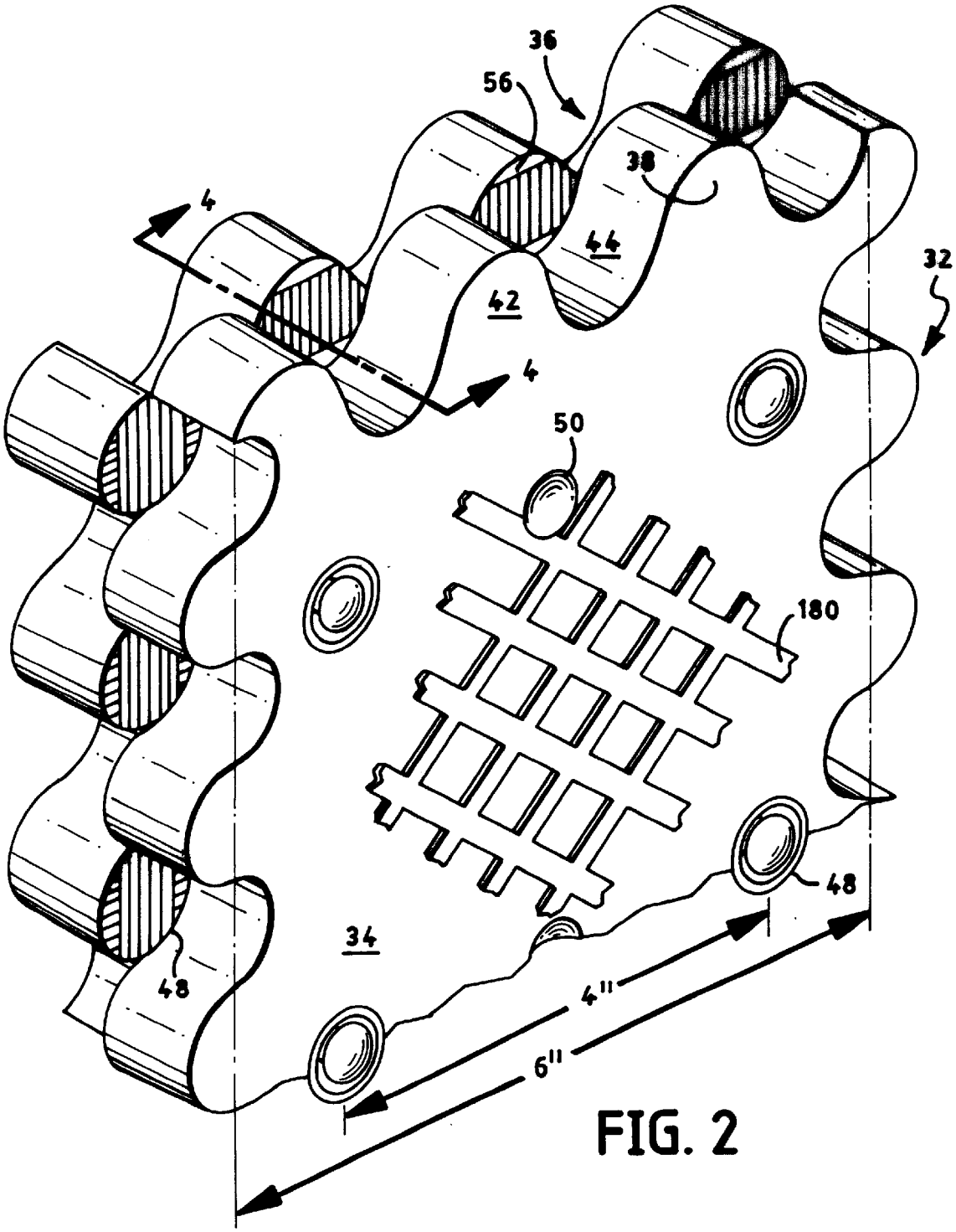
FIG. 2 is a perspective view of a panel.

A perspective view of a portion of the wall form panel 32 is shown in FIG. 2. The wall form panel 32 has a pair of planar sides 34, only one shown in FIG. 2, and four edges 36. The wall form panel 32 has a plurality of interlocking teeth or protrusions 38 which extend outward from the walls along the edges 36. The interlocking protrusions 38 are staggered in an offset pattern. The offset protrusions 38 are of equal width and staggered around a center plane 40 of the wall form panel 32. The interlocking protrusions 38 are formed of a plurality of similarly shaped teeth 42 and voids 44 wherein the teeth 42 on one side of the center plane 40 are aligned with the voids 44 on the other side of the center plane 40.

In a preferred embodiment, the interlocking protrusions 38 have teeth 42 and voids 44 which are of a curved semicircle shape. In addition, the interlocking protrusions 38 are aligned around the edges 36 of the wall form panel 32 such that the panel 32 has the same pattern no matter how the panel 32 is rotated about on the Cartesian axis as defined by the center of the panel 32. Each edge starts with a tooth 42 or a void 44 and ends with the other. Therefore if a planar side 34 of the panel 32 is facing a user, it does not matter which side or how oriented, this is referred to as rotationally symmetric.

The wall form panel 32, in addition, has a plurality of connector arms 48. The connector arms are embedded in the wall form panel 32 in a symmetric pattern and accessible from the planar walls 34.

The wall form panel 32 shown in FIG. 2 is a rectangular panel and in a preferred embodiment has a width or length of six inches and a height of 18 inches as measured to the center of the interlocking protrusions 38. The panel 32 has a thickness of two inches. As described below, the wall form panel 32 comes in various lengths, such as 2, 6, 18, and 54 inches in length.

In a preferred embodiment the wall form panels 32 are made of an expanded polystyrene (EPS) material. The connector arm 48 in a preferred embodiment is made of a hard plastic such as a high impact polystyrene. The use of a polystyrene base for both allows for ease of recycling broken parts.

Figure 3:
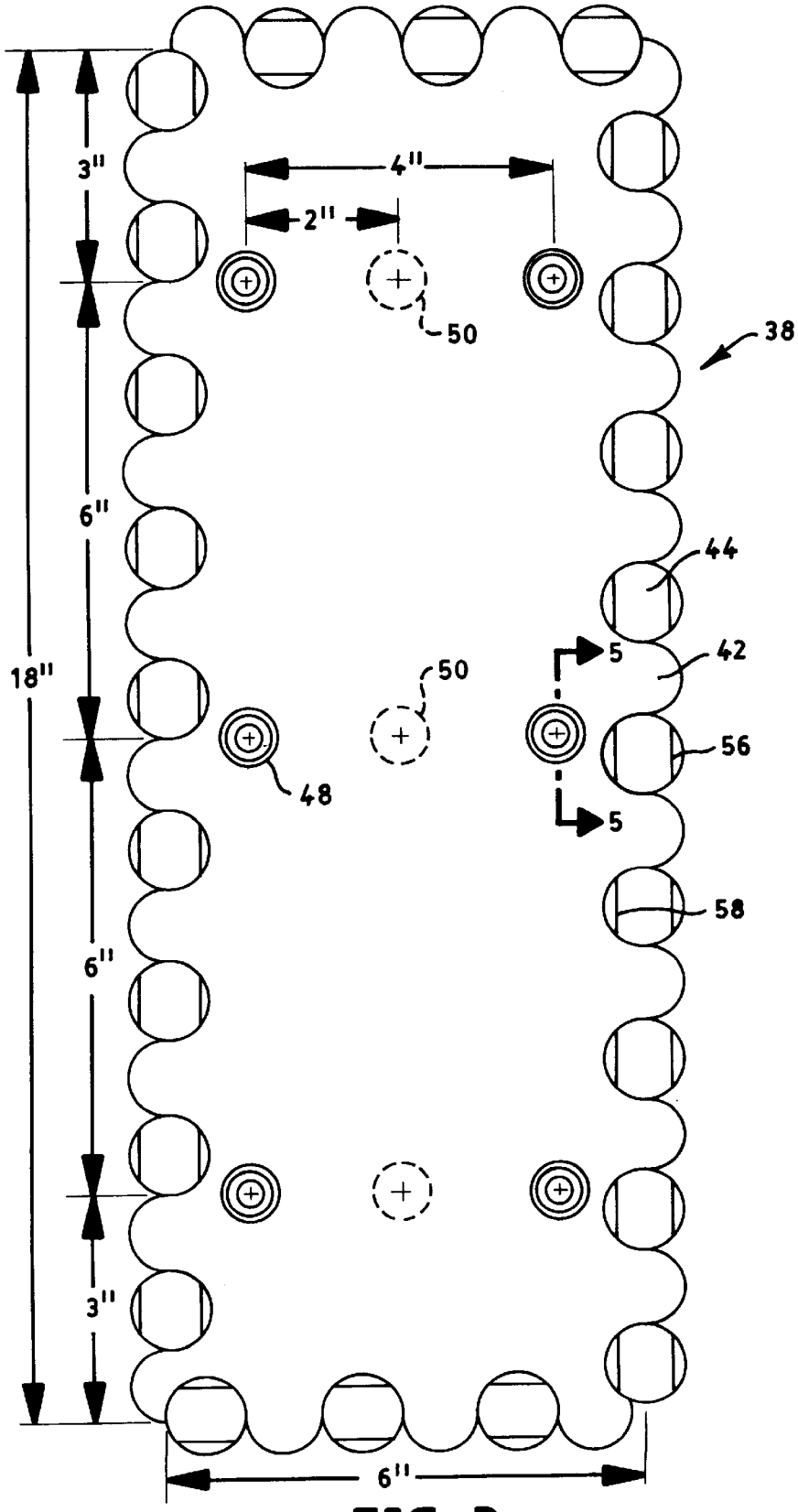
FIG. 3 is a side view of a panel.

Referring to FIG. 3, a rectangular wall form panel is shown. The wall form panel 32 shown has six connector arms 48 spaced in a pattern wherein the center point of the connector arm is located along a line that intersects the junction of the teeth 42 and the void 44 of the interlocking protrusions 38.

In a preferred embodiment, the wall form panel 32 shown in FIG. 3 has a height of eighteen inches and a width of six inches as measured from the center of the interlocking protrusions 38. Similar to the panel 32 shown in FIG. 2, the panel would have thickness of two inches. The connector arms 48 are positioned such that the center point is one inch from the center of the interlocking protrusions 38 along the sides and four inches apart horizontally. The connecting arms are spaced three inches from the center of the interlocking protrusions 38 in the vertical direction and positioned six inches apart from each other vertically. Dimples 50 are interposed horizontally between the connector arms 48.

Figure 4:
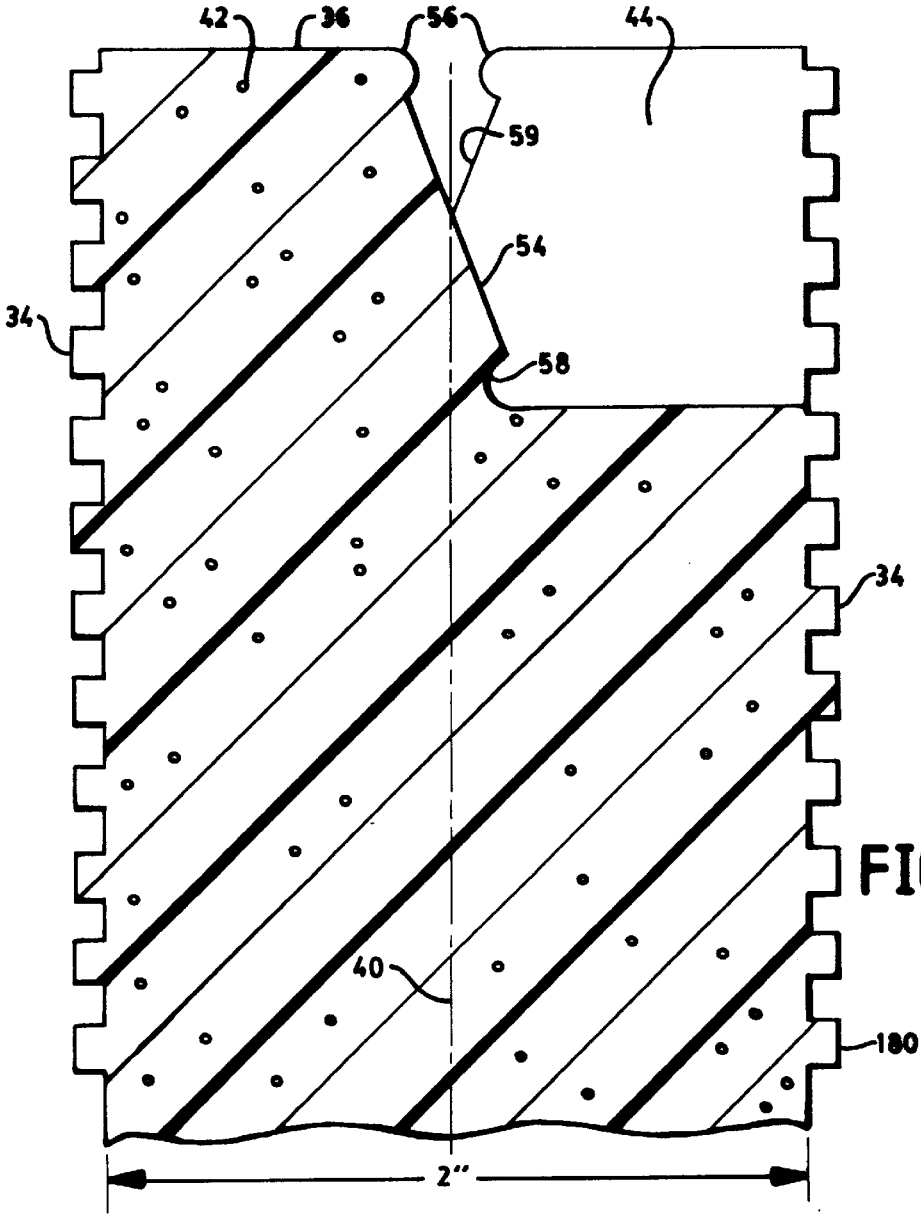
FIG. 4 is a sectional view taken along line 4—4 of FIG. 2.

FIG. 4 is a cross-sectional view showing a tooth 42 and a void 44 of the interlocking protrusions 38. Each of the teeth 42 has the outer planar wall, the planar side 34 and an inner wall 54. The inner wall angles at an angle of a, and has a projection 56 near the top surface defined by the edge 36 of the panel 32 and a complimentary groove 58 at the root of the tooth 42. The projection 56 and groove 58 assist in retaining adjacent wall form panels 32 together in engagement to form a modular form wall 22. In that the wall form panel 32 is made of an EPS material, the teeth 42 flex slightly to allow the projection 56 to engage in the groove 58. In a preferred embodiment, the angle a is approximately 20 degrees. The preferred angle a is a function of the EPS density selected based on the relationship of strength to insulation. The walls 34 of the wall form panel 32 are textured with a crosshatch pattern as seen in FIG. 2 and FIG. 4.

Figure 5:
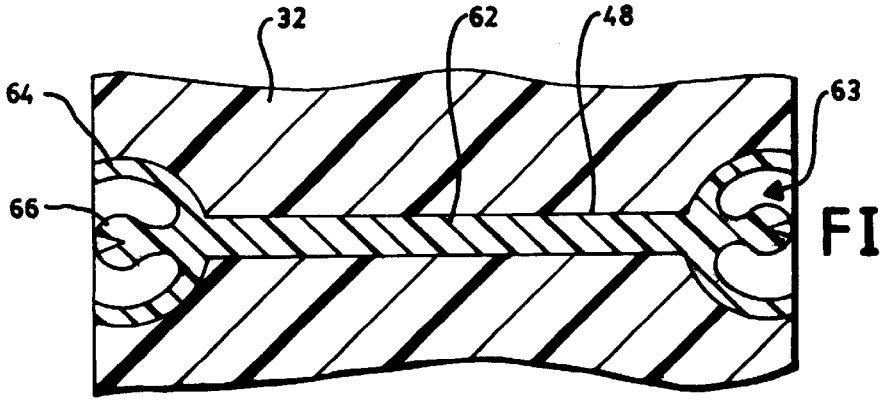
FIG. 5 is a sectional view taken along line 5—5 of FIG. 3.

FIG. 5 is a sectional view showing the connector arm 48 embedded within the wall form panel 32. The connector arm 48 has a rod or beam portion 62 which extends through the wall form panel 32. The connector arm 48 has a pair of connectors each with a hemispherical dome portion 64 at the end of the rod 62. The hemispherical dome portions 64 secure the rod 62 and prevent lateral motion of the rod 62 within the wall 34. The connector 63 of the connector arm 48 in addition each have a spherical ball 66 located within the hemispherical dome 64 for attaching the structural tie plate 24 as seen in FIG. 1 and described below.

Figure 6A:
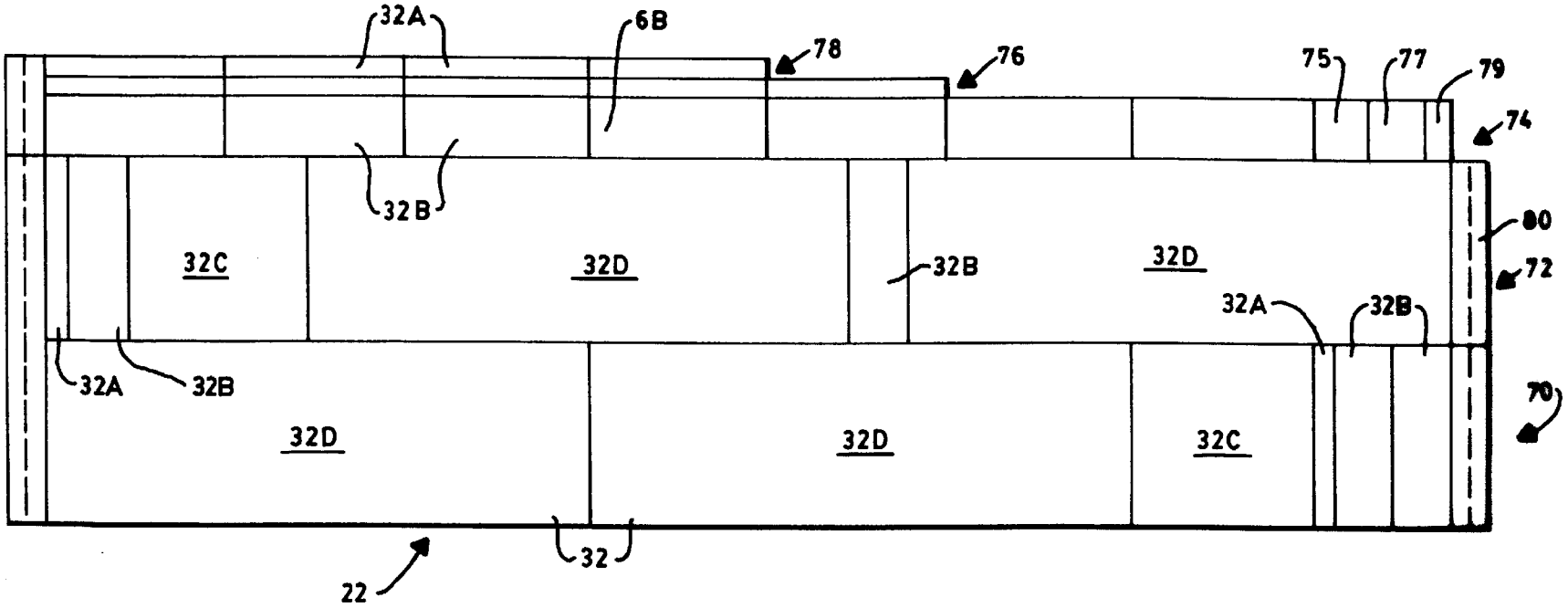
FIG. 6A is a side view of a plurality of panels.

The modular form wall FIG. 6A is formed from a plurality of wall form panels 32. The interlocking protrusions intermesh to form a solid continuous modular form wall 22. The wall form panels 32 come in a plurality of specific sizes such that a modular form wall 22 can be formed of a desired size by selecting and piecing together the proper components.

In a preferred embodiment the wall form panels 32 have a height of eighteen (18) inches and vary in length. The wall form panels 32*a*, in FIG. 6A, have a length of two inches and the wall form panels 32*b* have a length of six inches. The other two widths or lengths of the wall form panels 32*c* and 32*d* shown are a length of eighteen (18) inches and fifty-four (54) inches respectively. The panels have a set of specific length (width) $L=xy^n$ set by the following wherein in a preferred embodiment x=2 and y=3. n is an integer which increases by one therein when n=0, L=2 and when n=1, L=6. Therefore, the next panel length, not shown in FIG. 6A, would be 162 inches in length (i.e., when n=4).

The wall form panels 32 are combined to achieve the desired length of the modular form wall 22. The panels 32 are built up in a plurality of courses. In a first course, and a second course, 70 and 72 respectively, the course and the panels 32 have a height of eighteen (18) inches in a preferred embodiment. When the desired height of the modular form 22 is not equal to a multiple of eighteen (18), wall form panels 32 may be rotated such that the typical length is now the typical height and vice versa. For example, a third course 74 is formed of a plurality of six inch wall form panels 32C rotated such that the typical height eighteen (18) inches in a preferred embodiment is the length. A fourth course and a fifth course 76 and 78 respectively are formed from wall form boards 32A having a width, in this instance height, of two inches.

When a wall form panel 32 is desired that is a shorter length than available, a center section of the wall form panel 32 can be cut out using a hot wire or other technique and the end portions glued together to form the proper length. For example, in the third, fourth, and fifth course 74, 76, and 78, a wall form panel 32 of 14 inches in length is needed for each course from an eighteen (18) inch length, which is typical height. The right-most 14 inches of course 74 is filled by a pair of six-inch panels 75, 77 and a two-inch panel 79.

The modular form wall 22 of FIG. 6A is finished with a plurality of corner forms 80. The comer forms 80 have edges 36 with interlocking protrusions 38, as seen in more detail in FIG. 8. The interlocking protrusions 38 on the sides of the comer forms 80 interlock with the interlocking protrusions 38 of the wall form panels 32. The interlocking protrusions 38 on the top and bottom of the comer forms 80 interlock with interlocking protrusions 38 of adjacent comer forms 80.

Figure 6B:
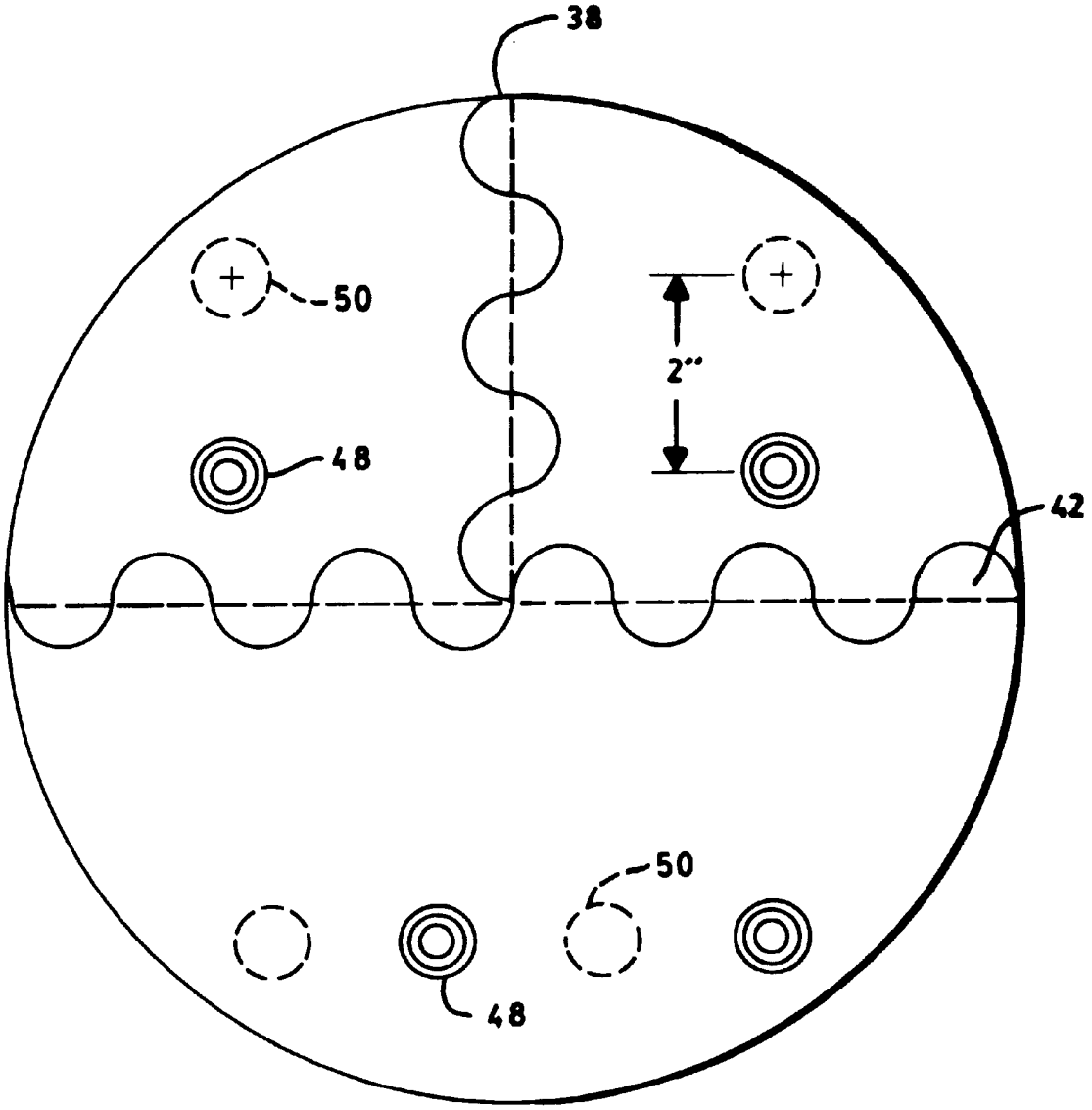
FIG. 6B is an enlarged view of the section labeled 6B of FIG. 6A.

The connection of the panels 32 is shown as a straight line. An enlarged view of the connection of a plurality of panels from FIG. 6A is shown in FIG. 6B in which the interlocking protrusions 38 are shown. The top of a lengthy wall form panel 32*d* is connected to two shorter staggered panels 32*b*. The interlocking protrusions 38 have teeth 42 and voids 44 which are accepted or accept voids 44 and teeth 42 of an adjoining panel. A dash-line represents the solid lines in FIG. 6A.

With the teeth 42 of the interlocking protrusion 38 having both a semi-circular shape as seen in FIG. 6B and FIG. 3, and in addition having tapered inner walls 54, the wall form panels 32 do not need to be aligned precisely prior to connection. The taper of the panels 32 allow the panel being installed to be misaligned slightly and move into position as it is placed in contact with the panel 32 on the modular form wall 22.

Figure 7A:
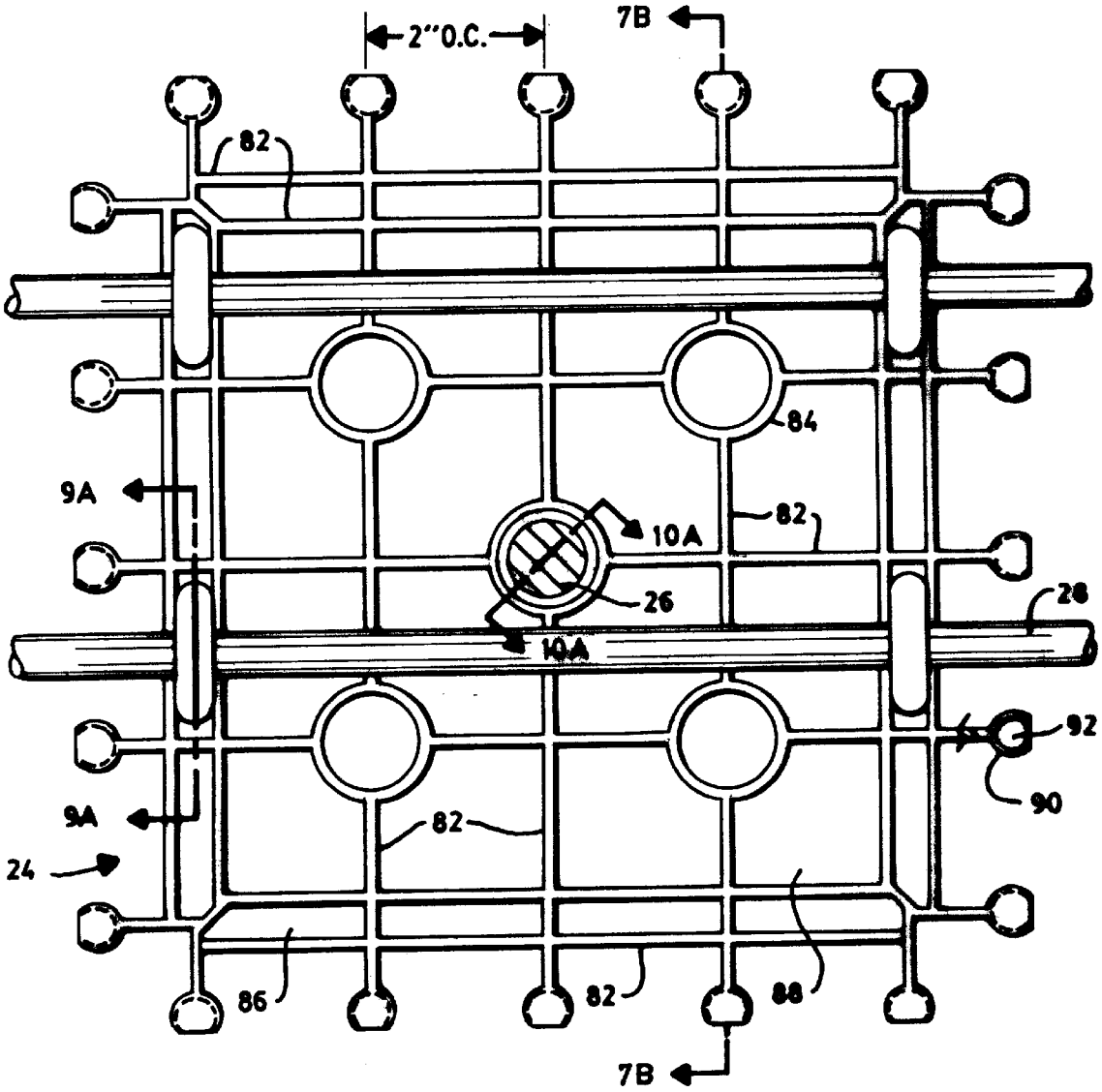
FIG. 7A is a top view of a structural tie plate.

A top view of a structural tie plate 24 is shown in FIG. 7A. The structural tie plate has a plurality of webs 82 extending generally longitudinally and laterally. The webs 82 define a plurality of circular openings 84, and a plurality of narrow rectangular openings 86, and a plurality of larger openings 88. Projecting from the outer webs 82 is a plurality of tie plate connectors 90. The tie plate connectors 90 each have a domed prong 92 which is adapted to be received in the connector arm 40 shown in FIG. 5. It is recognized that the webs could extend in a diagonal pattern as seen in FIGS. 15A, 15B, 16A, and 16B.

Figure 7B:
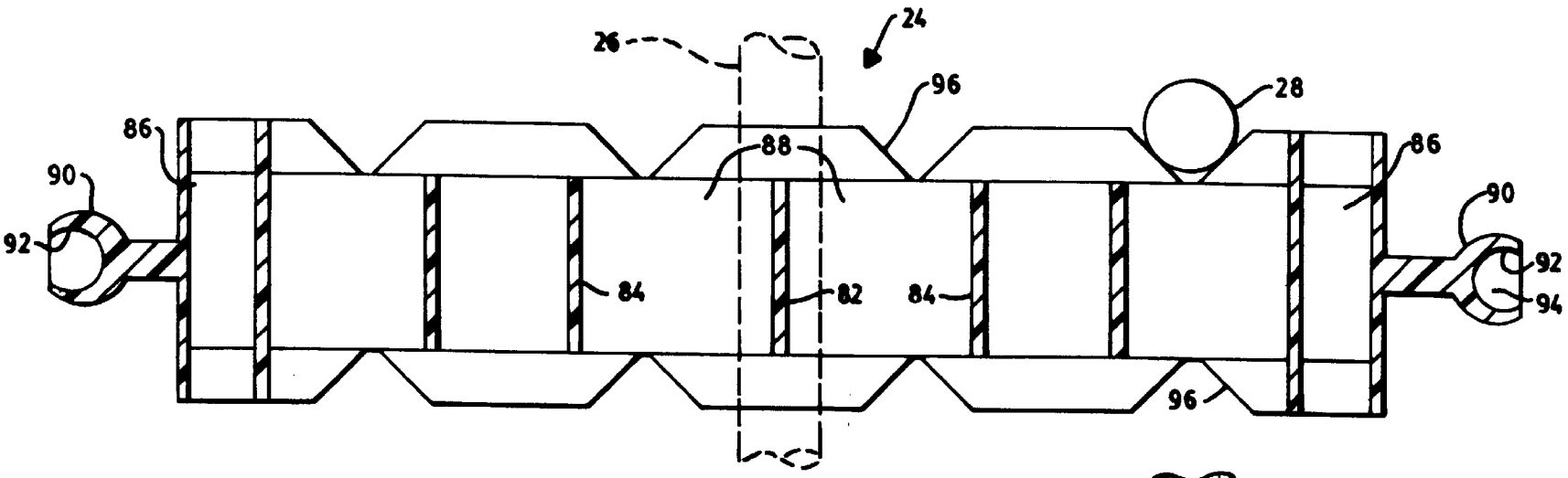
FIG. 7B is a side view of the structural tie plate of FIG. 7A.

A cross sectional view of the structural tie plate 24 is shown in FIG. 7B. The plurality of webs 82 of the structural tie plate 24 extend both in and out of the page and left to right as seen in FIG. 7B. The webs 82 have a plurality of notches 96 for receiving the horizontal reinforcement bars 28 as explained below. The tie plate connectors 90 are shown in a cross sectional view in FIG. 7B, with a chamber 94 of the domed prong 92 shown. It is recognized that the tie plate connectors 90, a male connector, could be found on the connector arm 48, and the connector portion 63, a female connector of the connector arm 48 could be found on the tie plate connectors 90.

In a preferred embodiment, the structural tie plate 24 shown in FIG. 7A has a width and length of 10 inches by 10 inches measured from the base of the prongs 92 of the tie plate connector 90. The depth of the structural tie plate 24 in a preferred embodiment is two inches. The structural tie plate 24 is made of a hard plastic such as high impact polystyrene.

Figure 8:
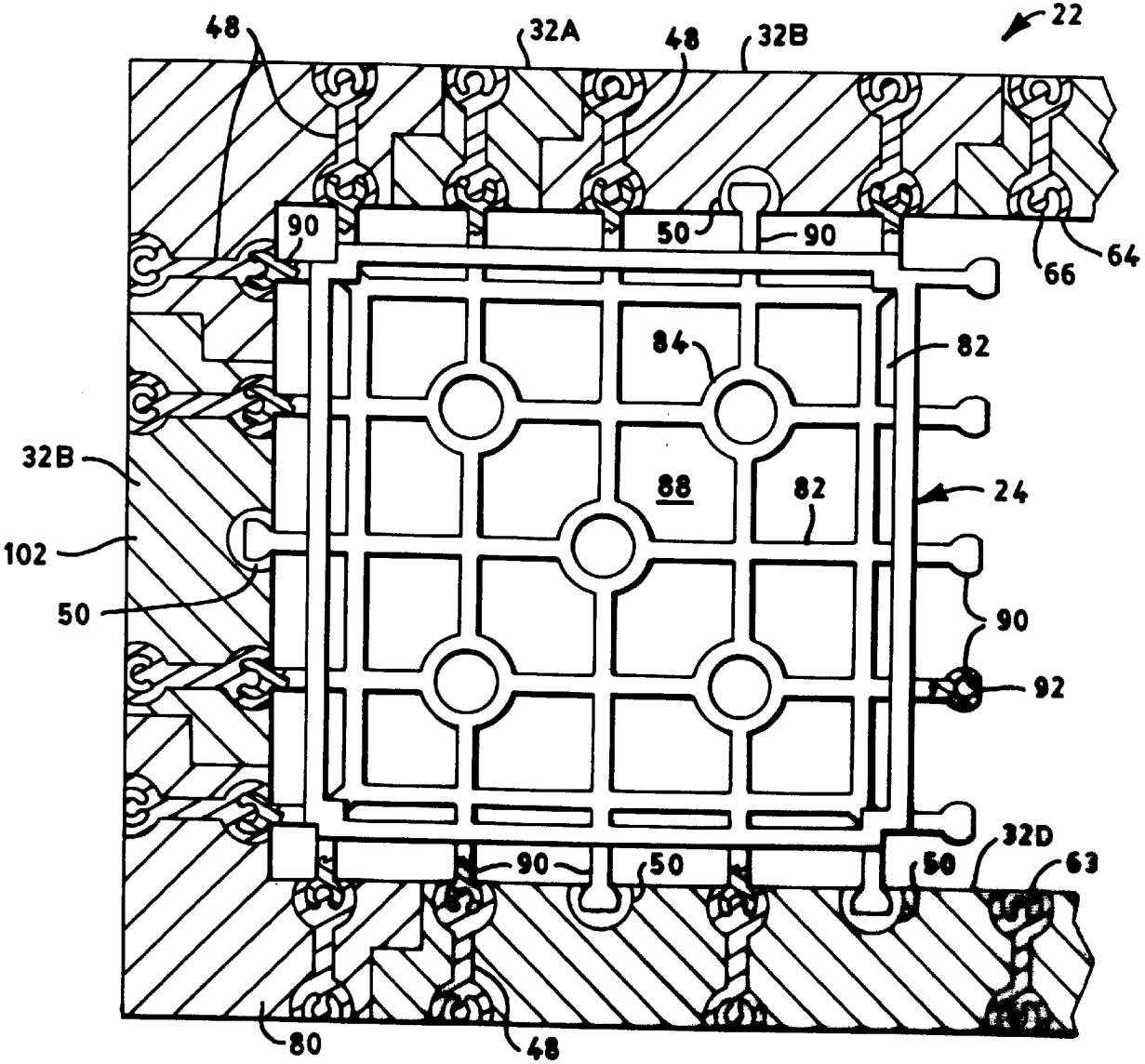
FIG. 8 is a top sectional view of a form having a panel and a structural tie plate.

The structural tie plate 24 of FIGS. 7A and 7B is shown attached to a plurality of connector arms 48 carried by the wall form panels 32 and the comer forms 80 in FIG. 8. A plurality of wall form panels 32 form two modular forms walls 22. The prongs 92 of the tie plate connectors 90 of the structural tie plate 24 are received by the connector portion 63 of the connector arms 48. The prong 92 of the tie plate connector 90 is received within the hemispherical dome 64 of the connector arm 48 with the spherical ball portions 66 of the connector arm 48 located within the chamber 94 of the prong 92 of the tie plate connector 90.

In a preferred embodiment as indicated above, the connector arms 48 are spaced apart in the wall form panels by four inches wherein the tie plate connectors 90 of the structural tie plate 24 are spaced apart by two inches. The prongs 92 of the tie plate connectors 90 which are not received by the connector arm 48 are received by the dimples 50 located horizontally between the connector arms 48, as seen in FIG. 3, on the wall form panel 32.

The structural tie plates 24, by having multiple connections, ensure that the two modular form walls 22 are parallel to each other. Referring back to FIGS. 1 and 2, in addition, in that the connector arms 48 in the wall form panels 32 are at specific heights (i.e., spaced six inches apart vertically, in a preferred embodiment), the connection from one modular form wall 22 to another modular form wall 22 results in making sure that the forms are vertically aligned.

In addition, FIG. 8 shows a pair of comer forms 80 that connect the two side walls to an end wall 102. The end wall 102 is created by wall form panels 32, and in the figure by a six inch wide panel 32B. The tie plate connectors 90 of the structural tie plate 24 likewise are received by the connector arms 48 in the end wall 102. As can be seen from FIG. 8, the spacing of the tie plate connectors 90 at a greater rate, i.e. at two inches rather than four inches, insures that all wall form panels 32 and comer forms 80 are tied into the structure by the structural tie plates 24 for rigidity and alignment.

Figure 9A:
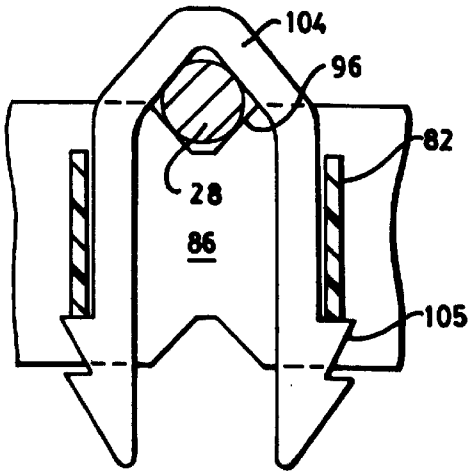
FIG. 9A is an enlarged view of a connector and the horizontal reinforcement bar taken along line 9A—9A of FIG. 7A—7A.
Figure 9B:
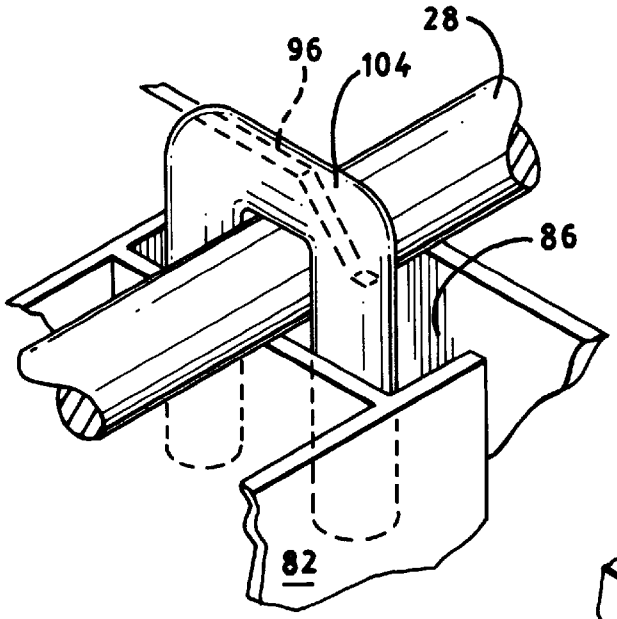
FIG. 9B is a perspective view of a connector and the horizontal reinforcement bar.

Referring to FIGS. 9A and 9B, the concrete wall system 20 has horizontal reinforcement bar lock-in clamps 104. The horizontal reinforcement bar 28 extends across the top of the structural tie plate 24 and positioned within the notches 96. The horizontal reinforcement bar lock-in clamp 104 is positioned between two webs 82 which form a narrow opening 86. The lock-in clamp 104 is of such a thickness to frictionally engage both walls of the web as seen in FIG. 9B. Alternatively the lock-in clamp 104 can have a pair of ratchet-like catches 105 which engage permanently with the web 82, as seen in FIG. 9A. The lock-in clamp 104 is angled at the portion that engages the reinforcement bar 28 to allow for various size reinforcement bar 28. Upon filling with concrete, the reinforcement bar 28, the structural tie plate 24 and the locking clamp 104 will be encased as one unit.

Figure 10A:
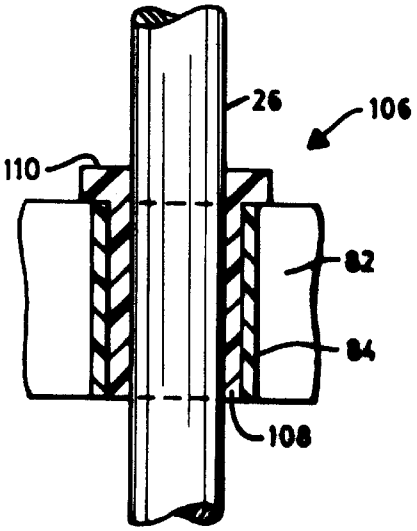
FIG. 10A is an enlarged sectional view of the connectors and the vertical reinforcement taken along line 10A—10A of FIG. 7A.
Figure 10B:
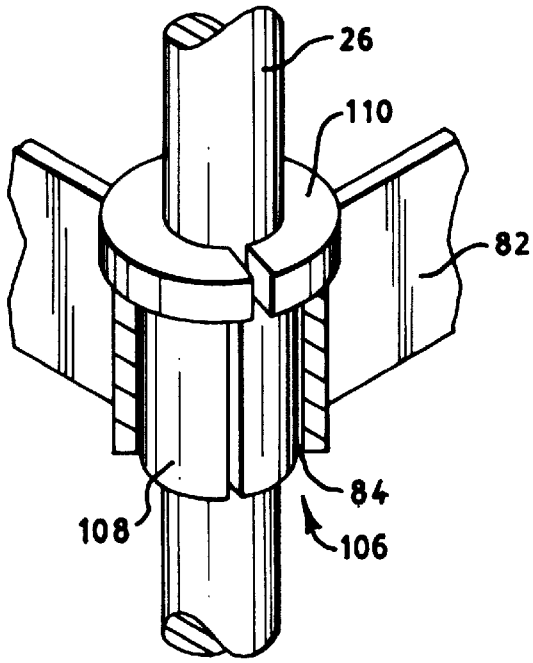
FIG. 10B is a perspective view of a connector and the vertical reinforcement bar.

Referring to FIGS. 10A and 10B, the concrete wall system 20 has a vertical reinforcement bar lock-in clamp 106. The vertical reinforcement bar 26 is received within the circular opening 84. The vertical locking clamp 106 has a cylindrical portion 108 which is positioned between the vertical reinforcement bar 26 and the circular opening 84 of the structural tie plate 24. In addition, the vertical locking clamp 106 has a lip 110 that rests on top of the web 82 defining the circular opening 84.

Figure 11A:
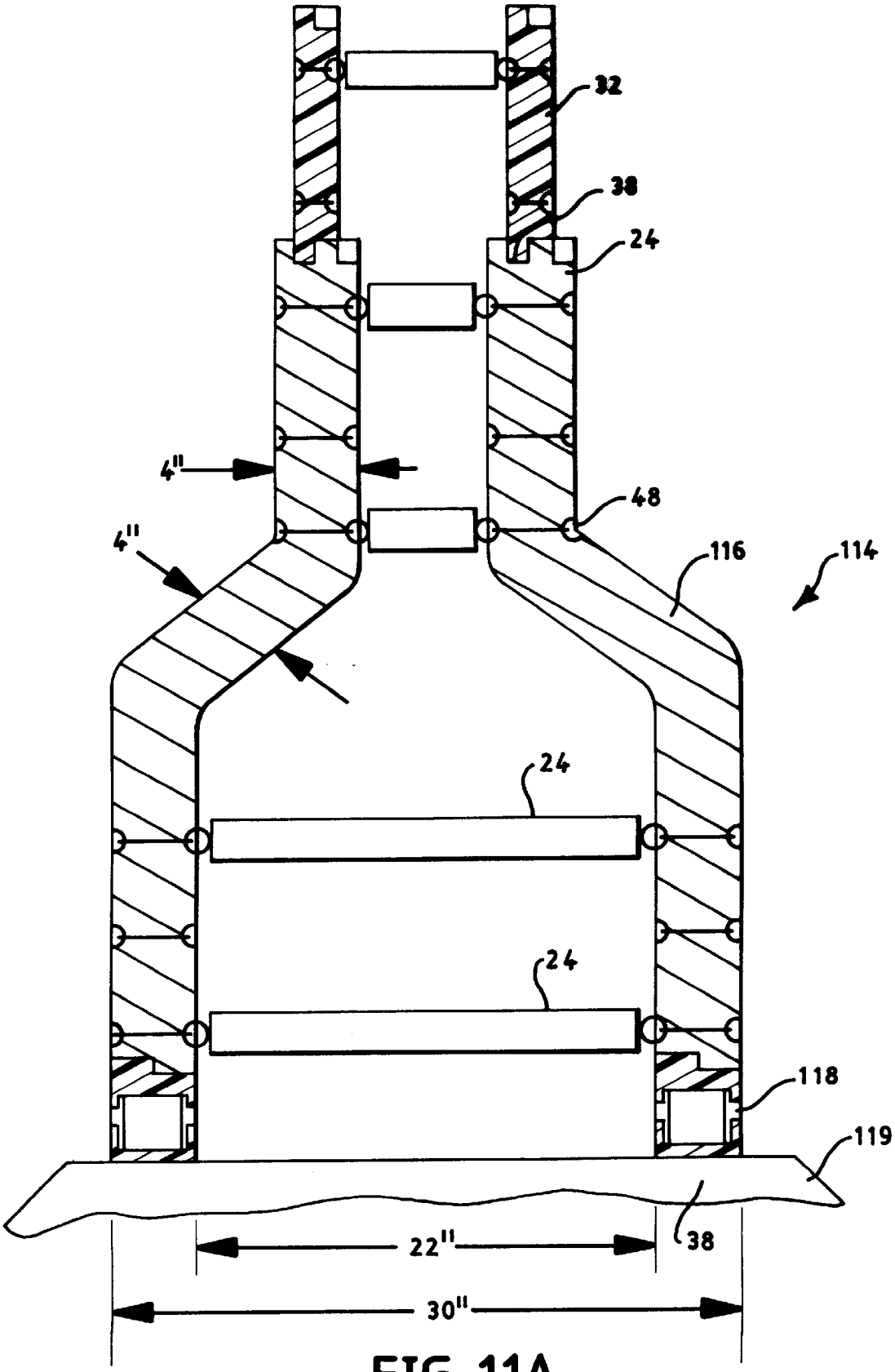
FIG. 11A is a side sectional view of a footing.

FIG. 11A is a side sectional view of a footing 114. The footing 114 has a curved wall form I 16, of similar material as that of the wall form panel 32 described above, having interlocking teeth 38 on the upper, lower and side edges. The curved wall form 116 of the footing 114 in addition has a plurality of connecting arms 48 for connecting with structural tie plates 24.

Below the curved wall forms 116 of the footing 114 is a drainage form 118. The drainage form 118 has the interlocking protrusions 38 arrangement as discussed above with respect to the wall form panels and corner panels. The drainage form 118 is a parallel pipe and has slots to allow water to move from around the foundation and drain towards the lowest spot of the foundation. The drainage forms 118 can be made either from EPS or an extruded hard plastic, are placed in a bed of gravel 119 to start as the base for the foundation. As seen in FIG. 11A, the curved wall form 116 on the footing 114 is of a greater width than that of the wall form panels 32. The symmetry of the interlocking teeth 38 allows the two different width pieces to interface. The interface occurs along the center plane 40.

In a preferred embodiment, shown in FIG. 11A the curved wall form panels 116 are six inches apart at the top and are connected by a pair of structural tie plates 24 as described with respect to FIGS. 7A and 7B. The lower portion of the curved form panel is connected with a structural tie plate 24 having a configuration similar to that shown in FIG. 7A but having a width of 22 inches.

Figure 11B:
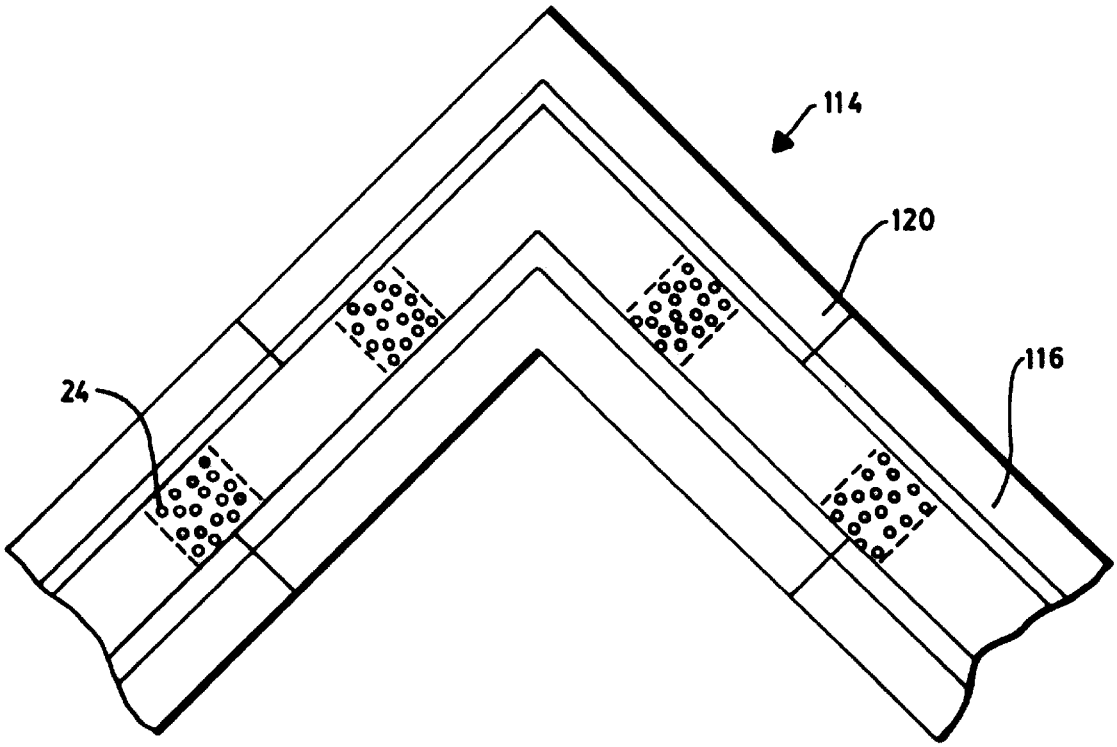
FIG. 11B is a top view of the footing.

Similar to the comer pieces described above, the footing portion 116 of the modular concrete wall system 20 has corner forms. The comer forms of the footing are curved comer angled foot form panels 120 as shown in FIG. 11B. The ends of the comer panels are staggered similar to those shown with respect to the comers above and the curved wall form panels 116 fill in to complete the wall.

Figure 12:
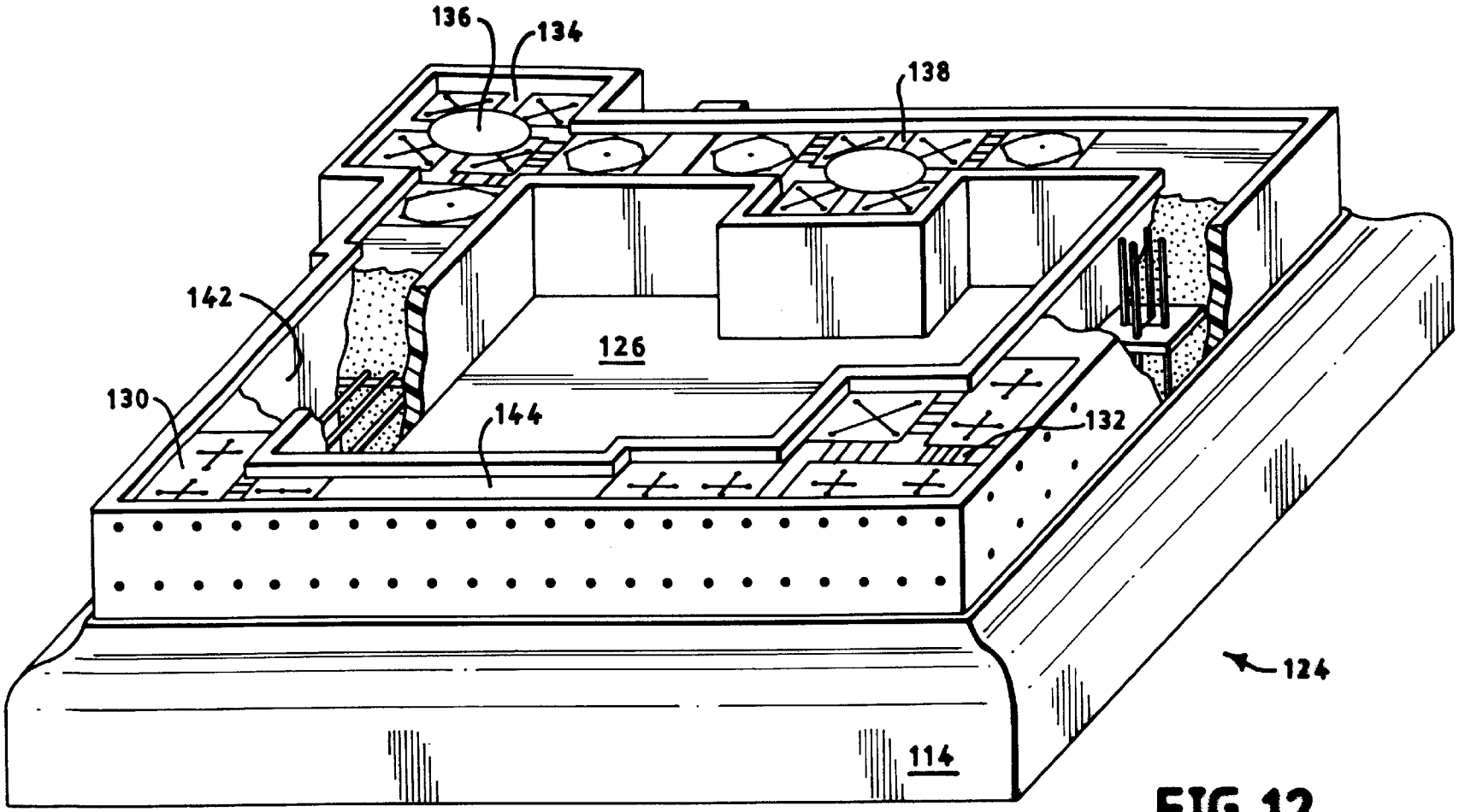
FIG. 12 is a perspective view of a foundation having various components.

FIG. 12 is a perspective view of a foundation 124 of the modular concrete wall system 20 having various components. A footing 114 as described above with reference to FIGS. 11A and 11B is seen on the outside wall. The ground would be back-filled in actuality and the footing 114 and a portion of the foundation 124 are hidden from view. A basement floor 126 is poured above the footing level in a conventional manner, therein the footing 114 is not seen on the inside of the foundation 124. In the lower left-hand comer of the FIG. 12 is a normal "L" shape comer 130 which is further described with respect to FIGS. 13A and 13B. In the lower right-hand comer of FIG. 12 is an enlarged comer pillar 132 shown as an inside building comer, formed having a plurality of structural tie plates 24 as further described in FIGS. 14A and 14B. In the upper left hand comer of FIG. 12 is shown an enlarged pillar 134 shown as an outside building comer, with a structural tie plate having a concrete pour hole, referred to as a structural pump tie plate 136, as further described with respect to FIGS. 15A and 15B. A "T" connection 138 is shown in the top center portion of FIG. 12 and further described with respect to FIGS. 16A and 16B.

Figure 13A:
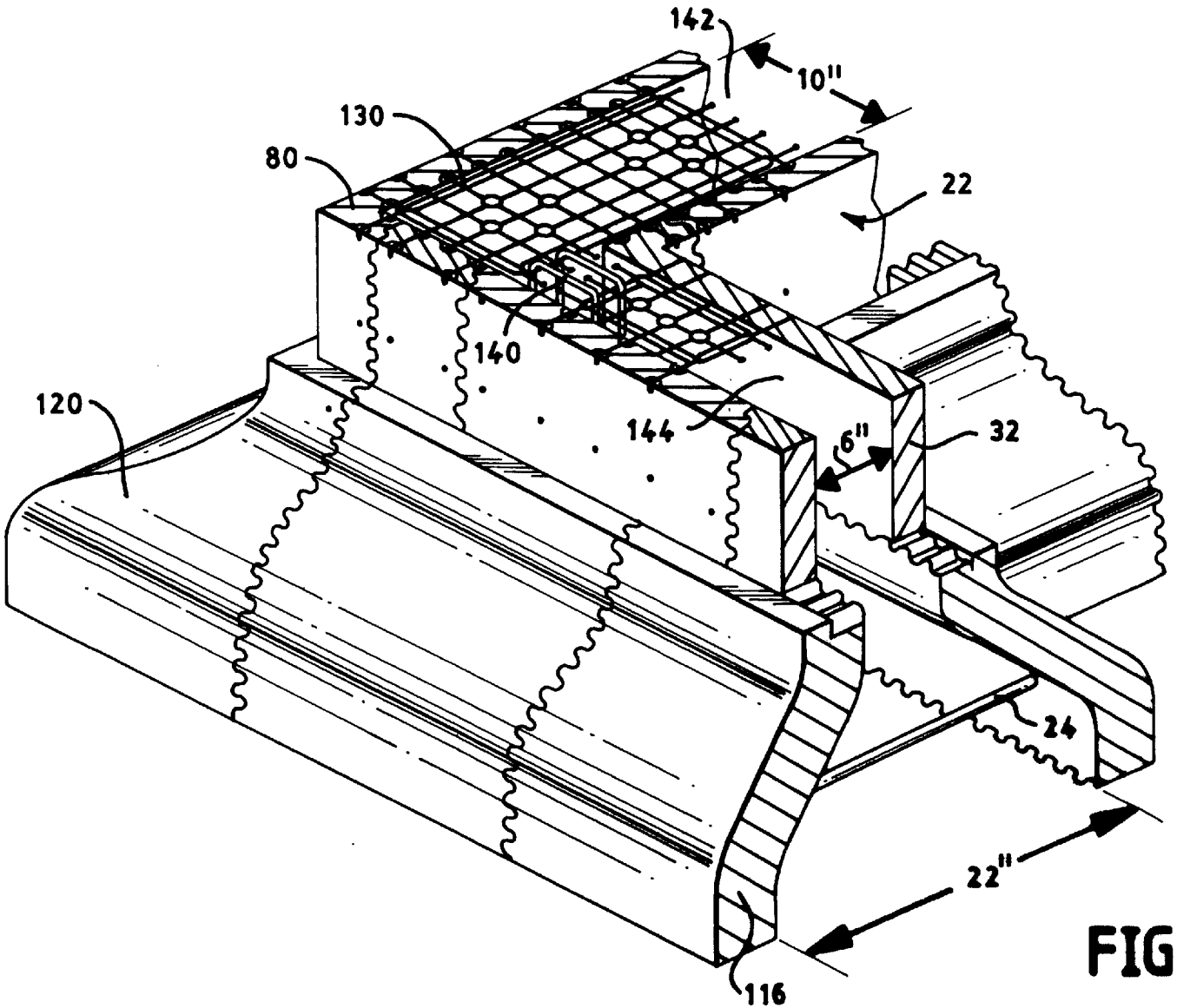
FIG. 13A is a perspective view of a "L" shaped corner.
Figure 13B:
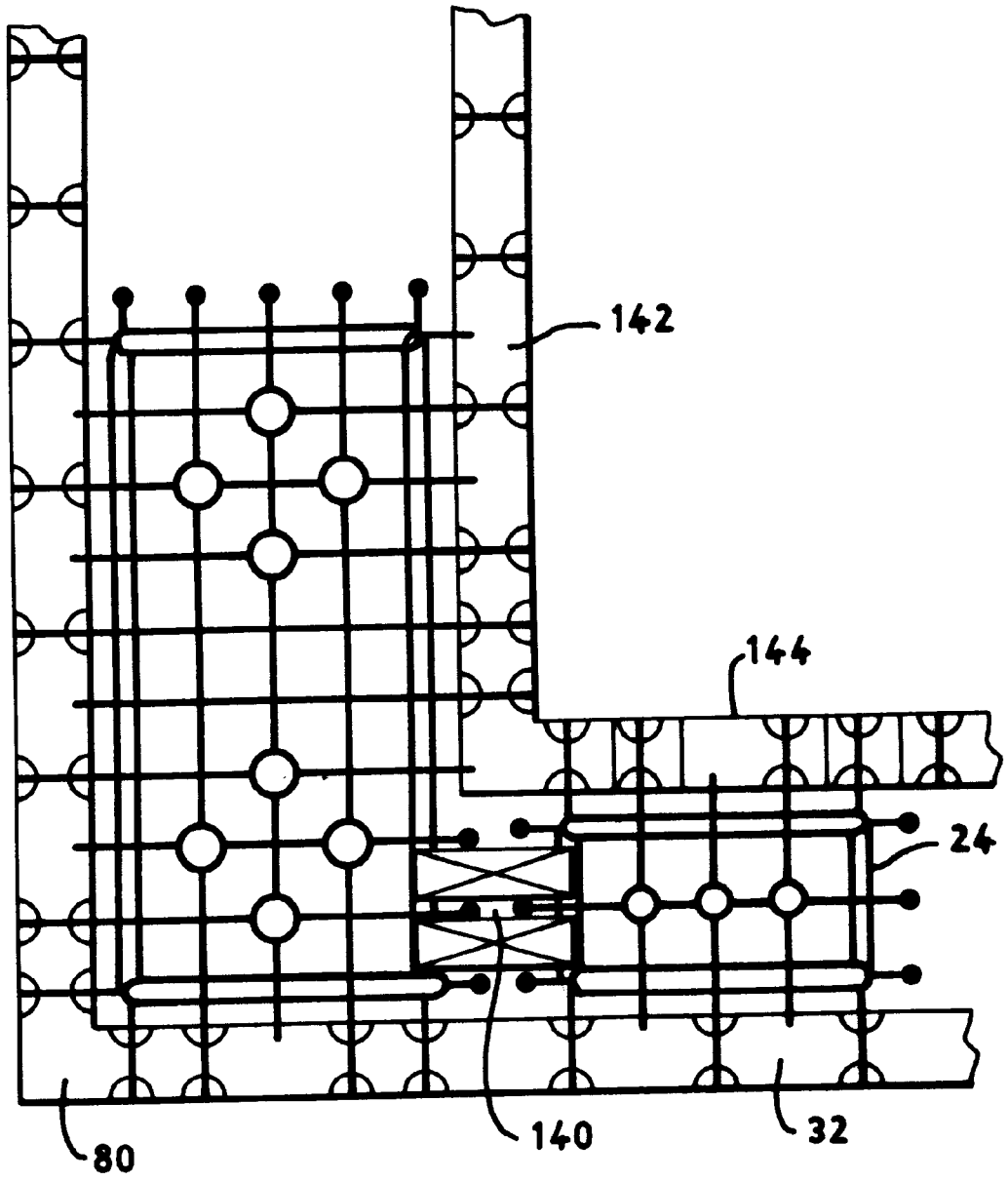
FIG. 13B is a schematic top view of the "L" shaped corner of FIG. 13A.

FIG. 13A is a perspective view of a regular "L" shape comer 130 and FIG. 13B is a top view of the same comer 130. The "L" shaped comer 130 is formed by a wall 142 formed by a pair of modular wall forms 22 spaced apart by structural tie plates 24 and a second wall 144 which is formed at a right angle and is similarly constructed from a pair of modular wall forms 22 of formed panels 32 with structural tie plates 24 interposed. The walls 142 and 144 are connected by the comer elements as described above with respect to FIG. 8.

The foundation 124 of the modular concrete wall system 20 is built starting with gravel 118 as seen in FIG. 11A, and the curved wall forms 116 are positioned above it including the comer footing 114. With these footings 114 positioned and structurally aligned and connected using the structural tie plates 24, as best seen in FIG. 13A, the wall form panels 32 are positioned on the curved wall form panels 116 of the footing 114. Each course is added in its entirety prior to adding the next course. The course is started in a comer using a comer form 80 or comer footing form 120. The wall form panels 32 are connected to the comer forms 80 both on the inner and outer modular form wall 22 to create the space for the concrete. The structural tie plates 24 then integrally connect the wall form panel 32 and the comer forms 80.

It is noted that the two walls 142 and 144 that join at the comer as shown in FIGS. 13A and 13B have a different width. The wall 142 shown on the upper portion of FIG. 13A, is in a preferred embodiment a ten (10) inch nominal wall thickness with a ten inch space between the two modular form walls 22. The modular form walls 22 are made of two (2) inch thick wall form panels 32. In a preferred nomenclature, the thickness of the wall is the thickness of the concrete, not including the added thickness of the modular form walls 22.

The wall 144 which is shown toward the lower portion of the page, is a six (6) inch wall thickness with a spacing of six inches between the two modular form walls 22. Because of the different thickness of the walls, the structural tie plates 24 within the walls are of a different size. The structural tie plate 24 shown in the front portion is of the same construction as that described above but in a different size. In a preferred embodiment however, the tie plate connectors 90 are still spaced two inches apart.

Figure 13C:
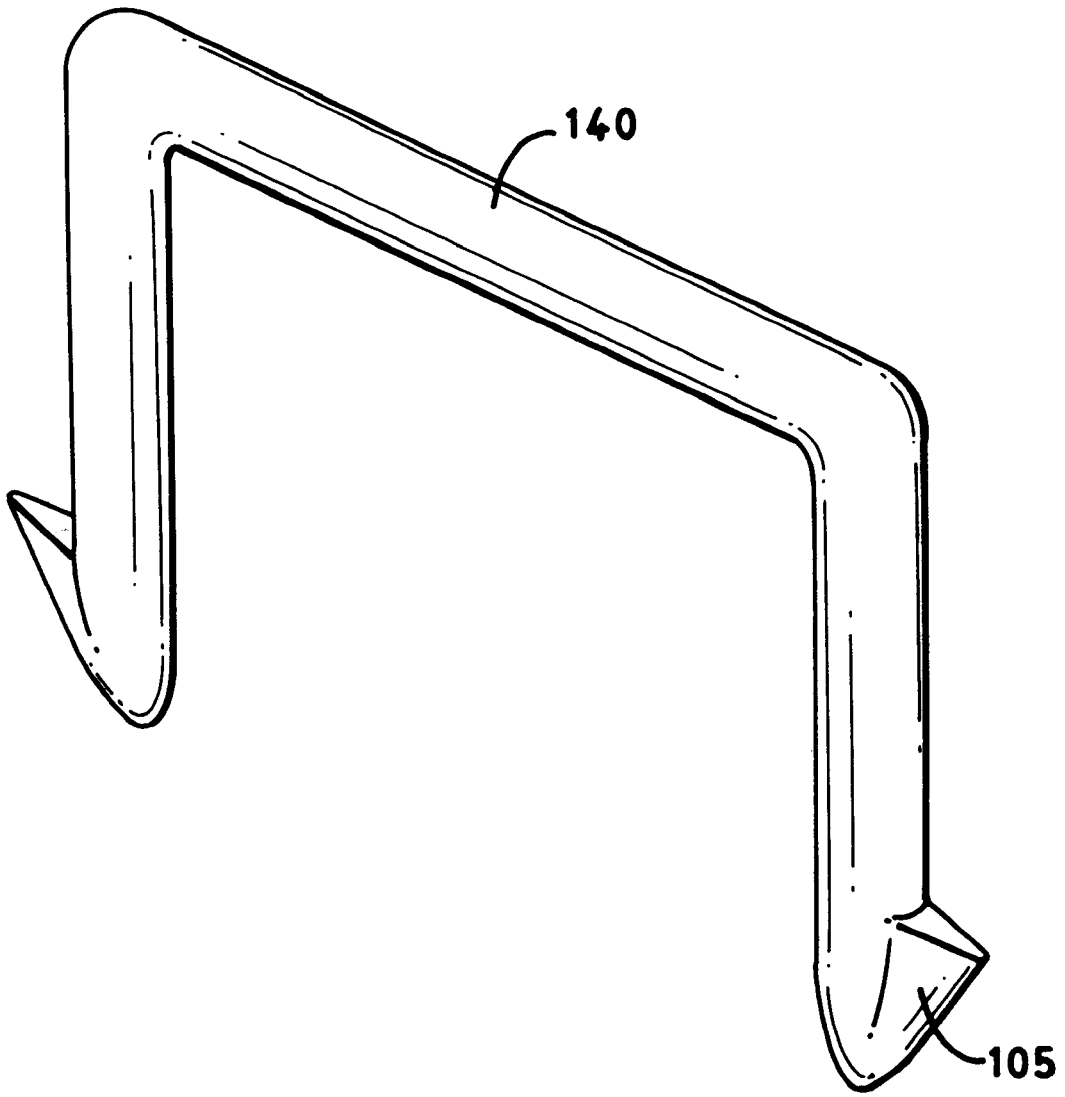
FIG. 13C is a perspective view of a connector of two tie plates.

The two structural tie plates 24 shown in FIGS. 13A and 13B are connected using a tie plate connector 140, which is shown in FIG. 13C. The tie plate connector 140 is similar to that of the horizontal reinforcement bar locking clamp 104 shown in FIGS. 9A and 9B. As with the horizontal reinforcement bar locking clamp 104, the tie plate connector 140 can have latch-like catches 105 to cause permanent engagement with the web 82.

Figure 14A:
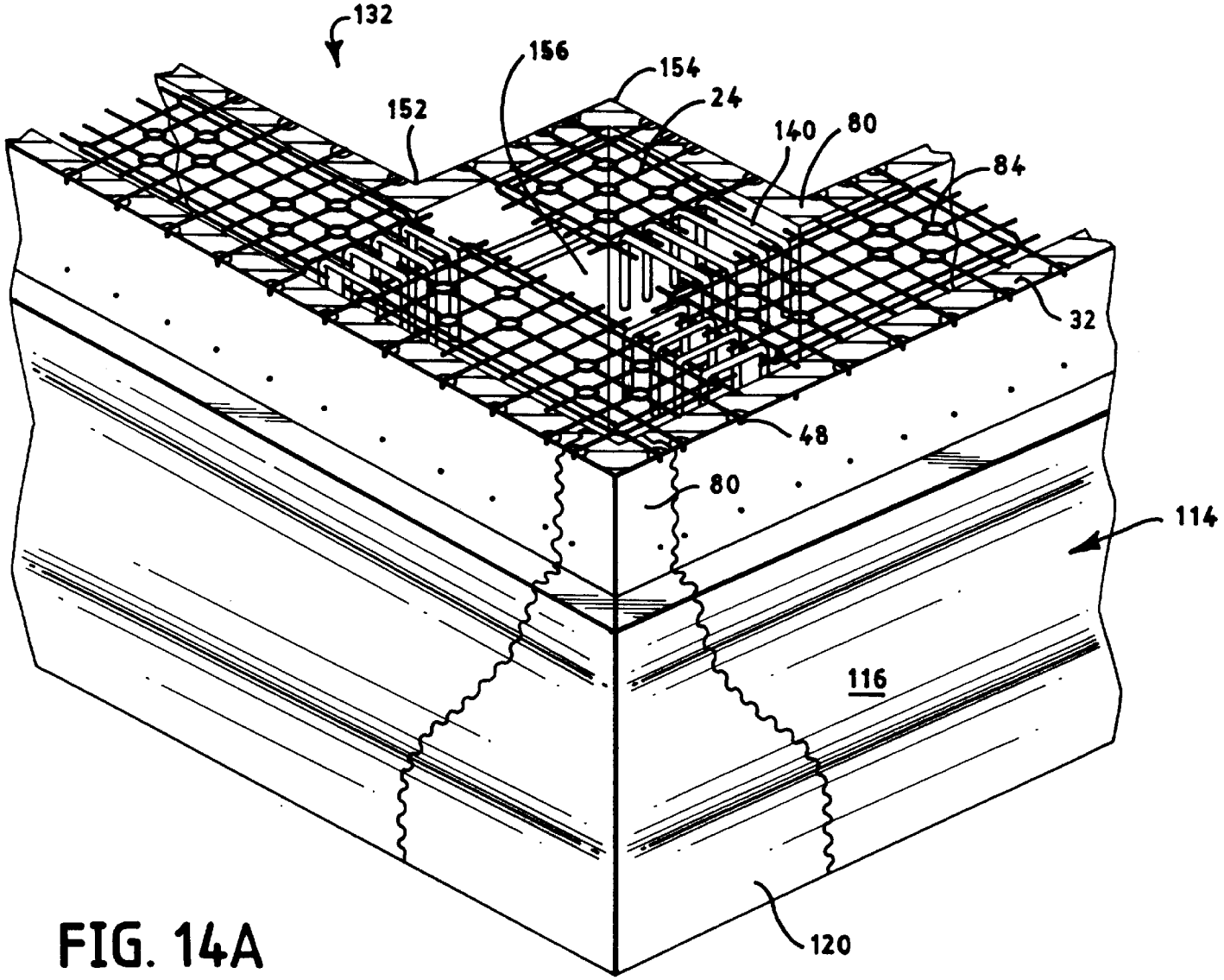
FIGS. 14A and 14B are a perspective view and a schematic view of an enlarged foundation comer.

FIG. 14A shows a perspective view of an enlarged comer pillar 132. In this comer pillar 132, the outer modular form wall 22 is constructed in a similar manner to that shown in FIGS. 13A and 13B. The inner modular form wall 22 of a first wall 148 and a second wall 150 stop prior to the "comer." Each wall 148 and 150 has a comer 152 which projects inward. A wall from each of the comers 152 extends until joined at another comer inner comer 154. This projecting inward and extending for a distance until the inner comer 154 forms a large area 156 in the comer 132. As seen in both FIGS. 13A and 13B, structural tie plates are used to connect the various wall form panels 32 and comer forms 80.

Figure 14B:
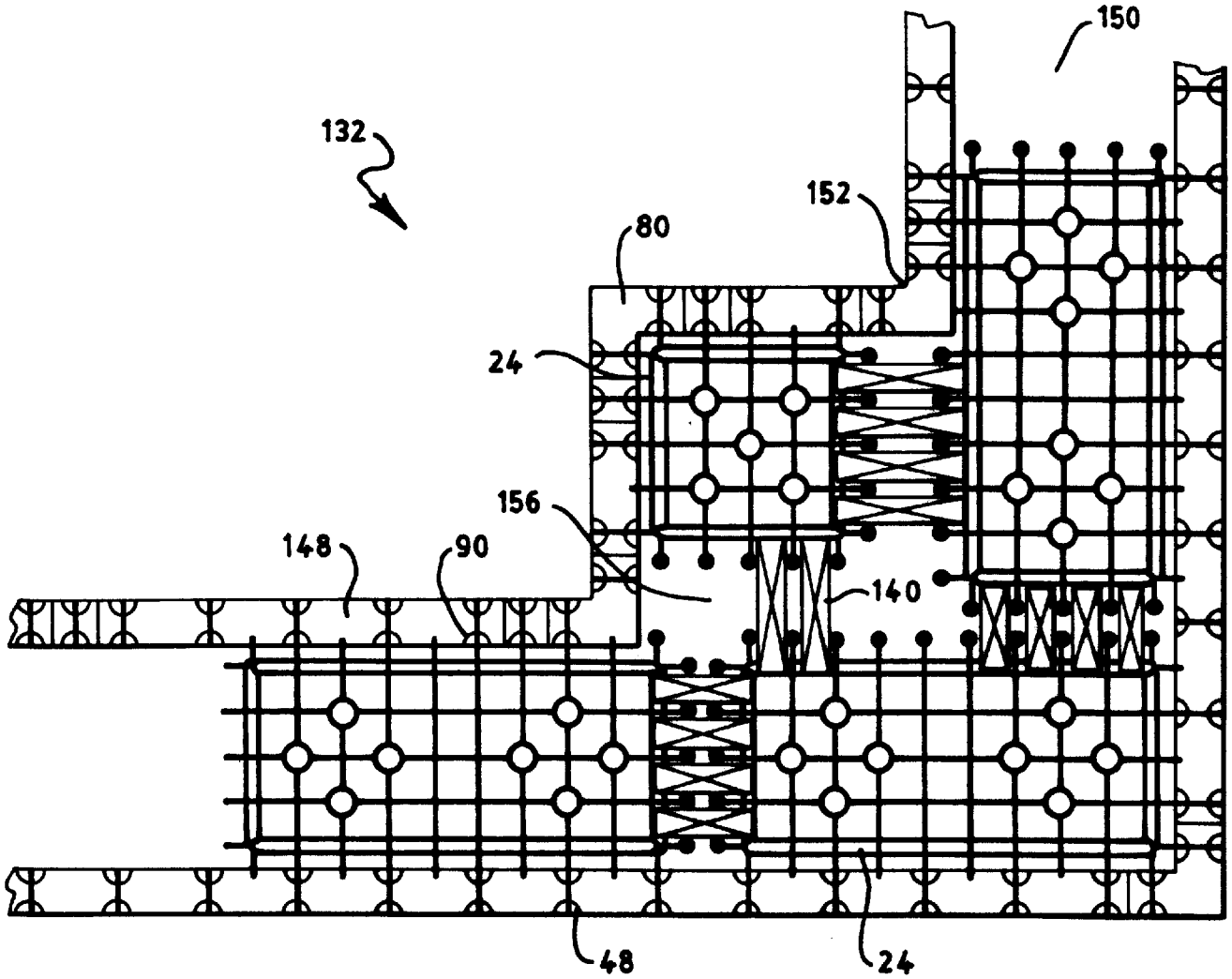

In the FIGS. 14A and 14B the size of the walls 148 and 150, in a preferred embodiment, is a nominal ten (10) inch wall with a space between the outer form walls 22 of ten inches for the concrete and structural tie plates 24, and the modular form walls 22 extending each an additional two (2) inches for a total of fourteen (14) inches. The enlarged comer is 24 inches by 24 inches. The structural tie plate 24 for securing the inner comer in the embodiment shown is 12"×12". It is recognized that this inner structural tie plate could be of a larger size such as 14 inches by 14 inches or 16"×16" to further tie in the other comer forms. The structural tie plate 24 is smaller than that needed to fill the whole area since it is desired to have sufficient connector arm 48 structural tie plate 24 connection yet minimize the amount of structural tie plates 24 needed. The structural tie plates 24 are connected using tie plate connectors 140, as described above with respect to FIGS. 13A and 13B and further described in FIG. 13C.

Figure 15A:
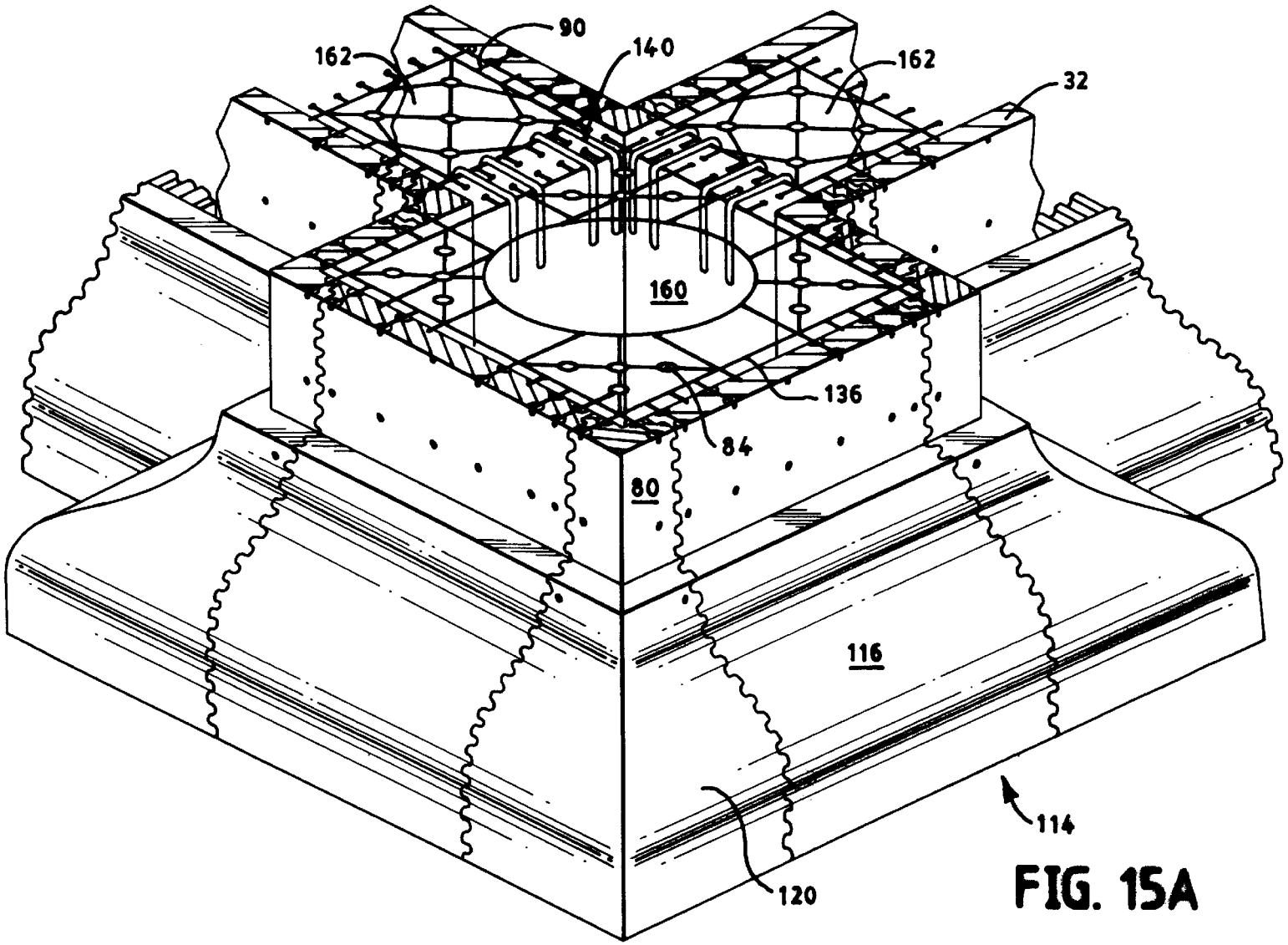
FIG. 15A is a perspective view of an enlarged comer pillar.
Figure 15B:
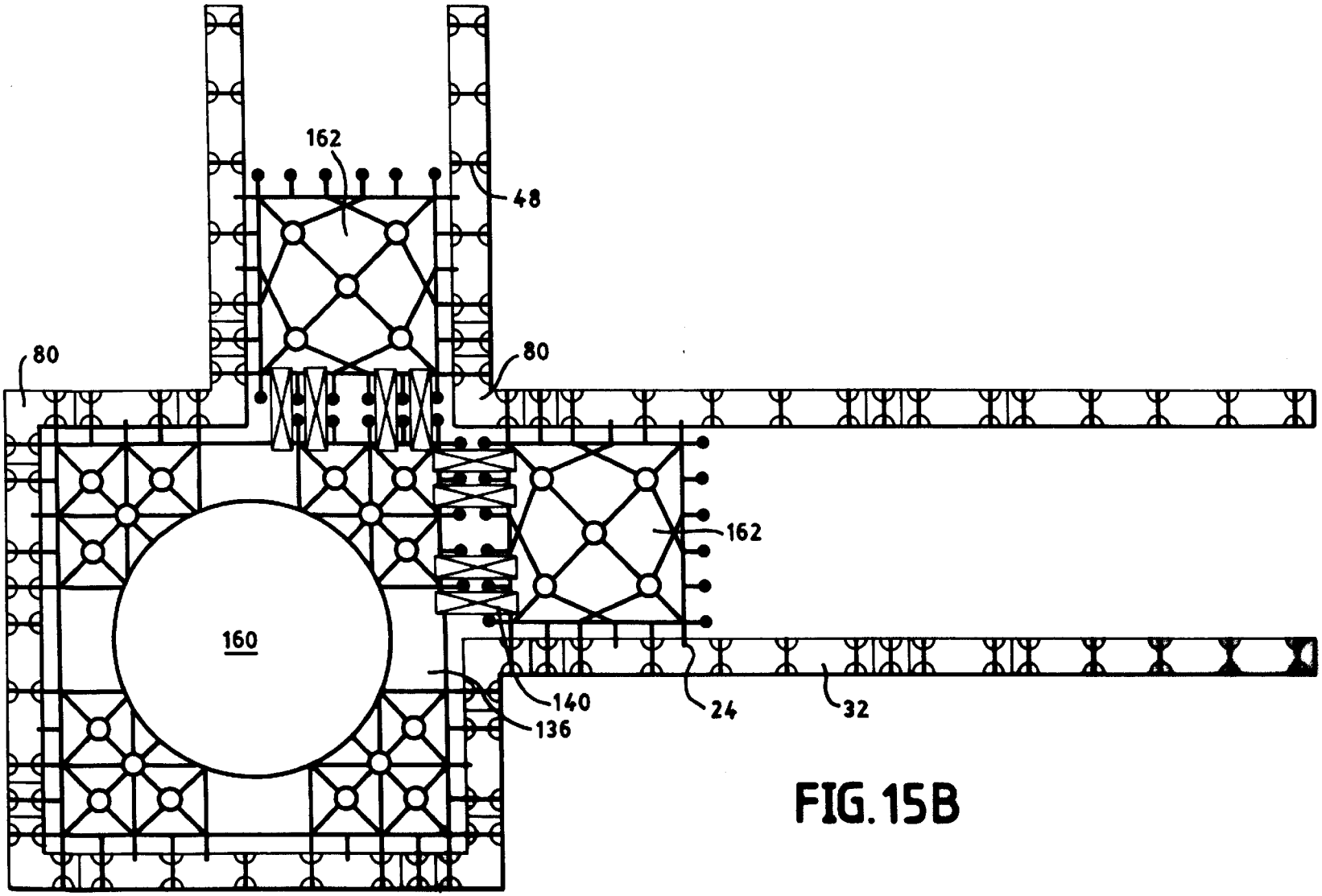
FIG. 15B is a top schematic view of an enlarged comer pillar.

The enlarged pillar 134 with the structural pump tie plate 136 as shown in the upper left-hand comer of FIG. 12 is shown from the outside of that comer, in a perspective view in FIG. 15A and in a top view in FIG. 15B. While the enlarged pillar has a different shape, the modularity of the wall form panels 32, the comer forms 80 and structural tie plates 24 allow for these various shapes of comers and "T" connections to be built.

The structural pump tie plate 136 has a large circular opening 160 to allow a pumping hose from a concrete machine. This opening 160 allows the concrete to be placed in the support more easily. It should be noted that the circular openings 84, large openings 88, and the narrow openings 86 of the structural pump tie plate 132 and the structural tie plate 24 are of a size that the aggregate of the cement will flow through these openings. Structural reinforcement bars 26, not shown in this figure, extend vertically in the outer edges of the corners through selected circular openings 84. In addition, horizontal reinforcement bars 28 extend horizontally from the comer along the walls.

In addition to the structural pump tie plate 136, the comer shows a pair of structural tie plates 162 having a different web configuration. These structural tie plates shown have a diagonal web configuration, in contrast to the horizontal and longitudinal on figuration shown above.

Figure 16A:
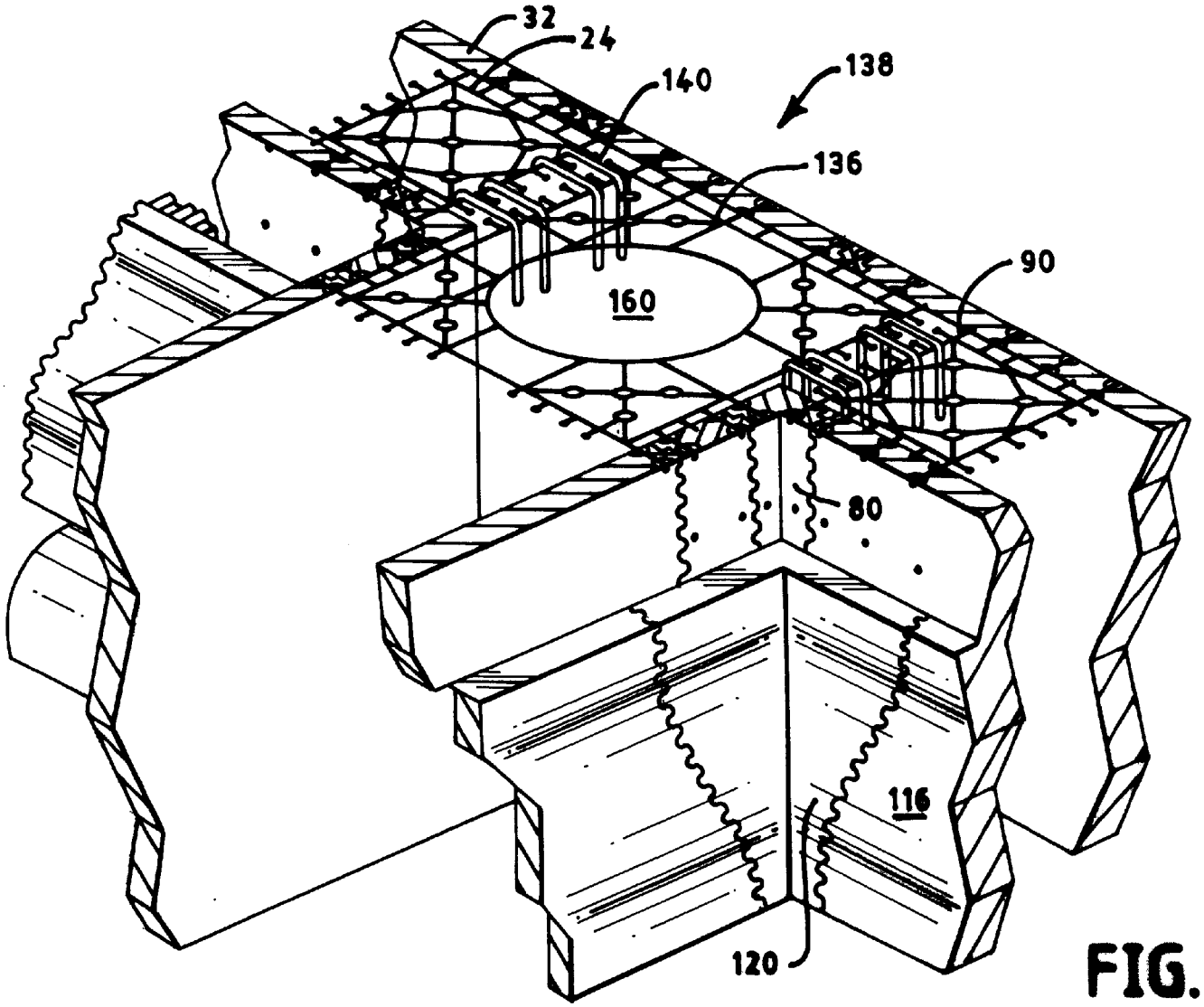
FIG. 16A is a perspective view of a "T" connector.
Figure 16B:
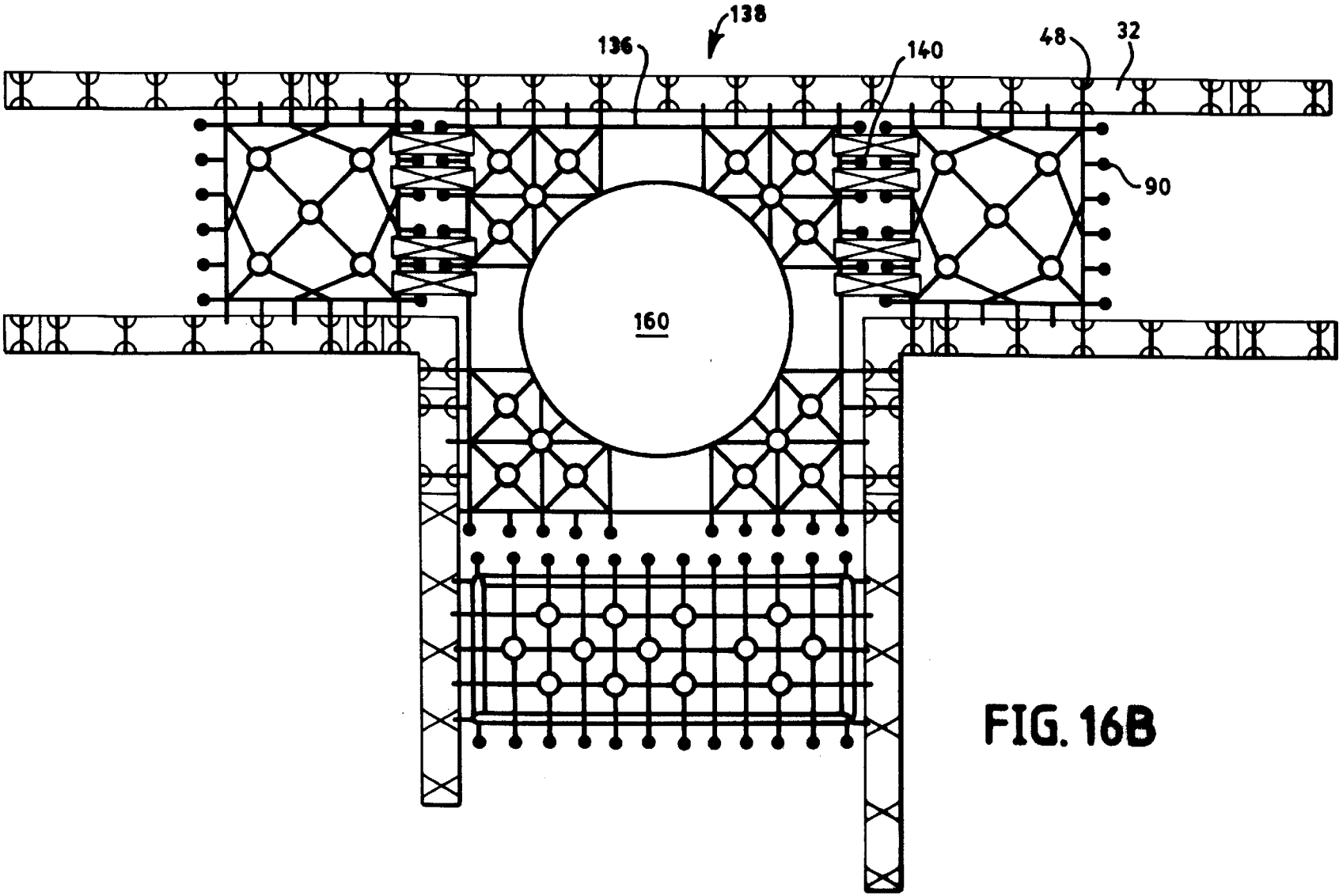
FIG. 16B is a top schematic view of the "T" connector.

FIGS. 16A and 16B show "T" connections 138 where structural pump tie plates 136 are positioned in the junctions of the walls. The "T" connection 138 shown in FIGS. 16A and 16B shows a twelve (12) inch wall running along the top of FIGS. 16A and 16B. The adjoining connecting wall is a 24 inch wall. (In both cases the nominal length does not include the four (4) inches of the wall form panels (i.e. two inches on each side). The structural tie plates 24 shown in the wall extending across the top have the diagonal web configuration in contrast to the horizontal and longitudinal webs shown in FIG. 16B. It is recognized that an inner wall can continue from this point. While the inner wall is shown just extending a brief distance from the outer structure, the inner wall could connect to another wall to divide the foundation in half. This inner wall could be a bearing wall if desired. In addition, this inner wall could be T-connected to another wall.

While various connections and comers have been shown in FIGS. 12 through 16B, it is recognized that with the modularity of the wall form panels 32, the comer forms 80 and the structural tie plates 24, other shape comers and connections can be formed.

Prior to arriving at a building site, the designer, architect, contractor, or engineer can determine what materials are needed, for example how many and what size wall form panels 32, structural tie plates 24, and comer forms 80. In that the materials are lightweight once the components are on site, a single individual can assemble the modular forms to create the modular concrete wall system. The specific spacing of the connector arms 48 ensure that the structural tie plates 24 are positioned correctly, and the structural tie plates 24 ensure that the walls are properly aligned. In that the wall form panels 32 are reversible as described above, the assembler can assemble the modular form quickly since the wall form panels 32 will align, no matter which edge is pointing towards the modular wall form 22.

In typical construction, a ditch is dug, along the perimeter and extending to below the frost line and below any basement foundation. The ditch is filled with a drainage material such as crushed rock 119. A comer is assigned to be a reference comer. The footing 114 and wall form panel 32 are assembled.

As indicated above with respect to FIGS. 11A and 11B, a drain form 118 for draining away water is positioned on top of the crushed rock 119. The footing 114 is positioned on top of the drain form 118. The footing is started in a reference comer starting with the comer fitting 120. The footings 114 formed from a curved wall form 116 are connected. After the curved wall forms 116 are connected, the structural tie plates 24 are positioned between the modular form walls 22 to connect the curved wall forms 116. Typically, a course of wall form panels 32 are positioned on top of the footings 1 14 prior to inserting the vertical reinforcement bars 26. The horizontal reinforcement bars 28 are placed on top of the structural tie plates 24 as soon as that layer of structural tie plates are positioned. Upon building higher courses such as the second 72 or third 73 course, the structural tie plate 24 is positioned with its circular opening 84 receiving the already vertically extending vertical reinforcement bar 26.

While two (2) inch thick wall form panels 32 and comer forms 80 have been discussed above, it is recognized that the panels can have a thickness of four (4), six (6), or ten (10) inches or any other size dependent on insulation requirements because of climate or code. Likewise, the structural tie plates 24 and the thickness of the concrete can vary. The structural tie plates 24 can have a width of four (4), six (6), ten (10) inches, etc., dependent on the desired width of the wall. In addition, the structural tie plate 24 can be square or rectangle as seen for example in FIG. 14B.

Figure 17:
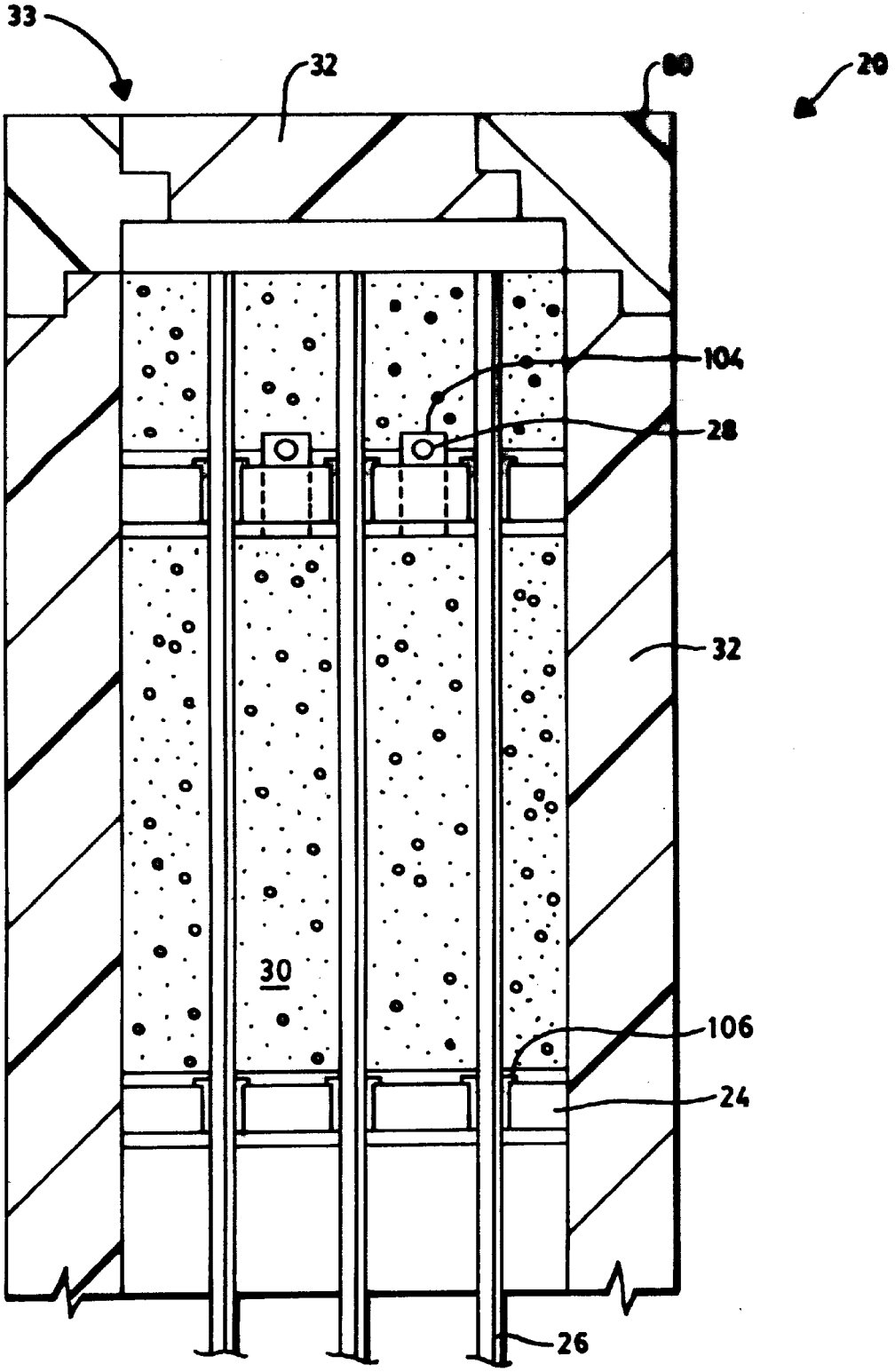
FIG. 17 is a sectional view of a section with a head cap.

In the pouring and curing of concrete, it is necessary to keep the temperature of the concrete in a proper range and to control the rate of moisture evaporation. FIG. 17 illustrates a cross sectional view of a cross-section of a modular concrete wall system 20 with a heat cap. The heat cap is formed by placing a comer form 80 on top of the walls and using wall form panels 32 on top to cover the poured concrete 30. FIG. 17 in addition shows a plurality of structural ties with both horizontal and vertical reinforcement bars 28 and 26 respectively connected, horizontal reinforcement bar locking clamps 104, and vertical reinforcement bar locking clamps 106, as previously discussed. Upon the concrete properly curing, the heat cap is removed.

In addition to the modular concrete wall system 20 being used for the foundation 124, the wall system 20 can in addition be used for walls. When the wall system 20 is above ground level the modular wall form 22 is covered.

Figure 18A:
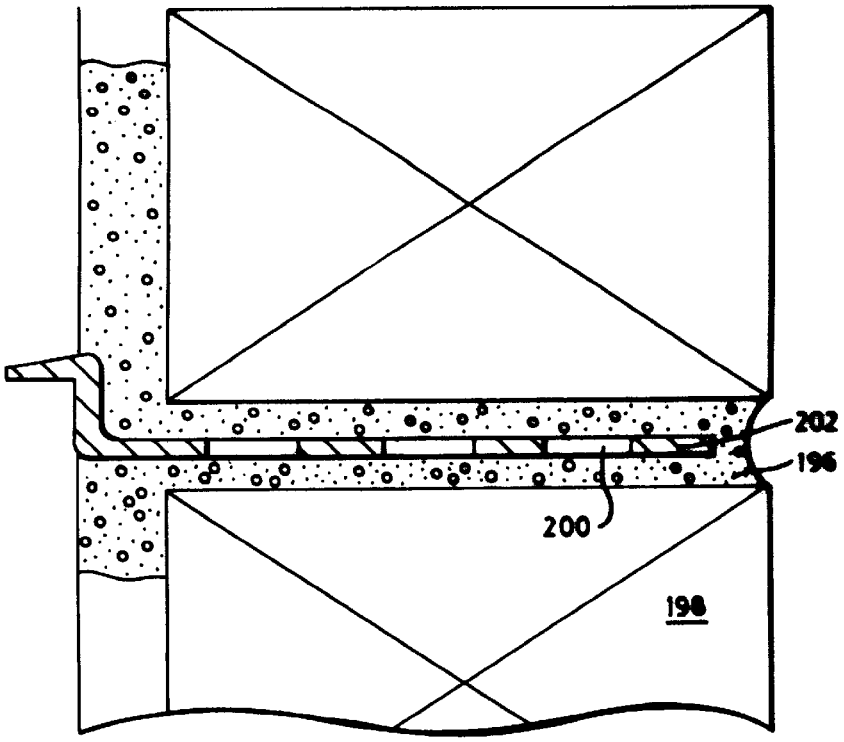
FIGS. 18A and 18B are a top and side view of a brick/stone tie.
Figure 18B:
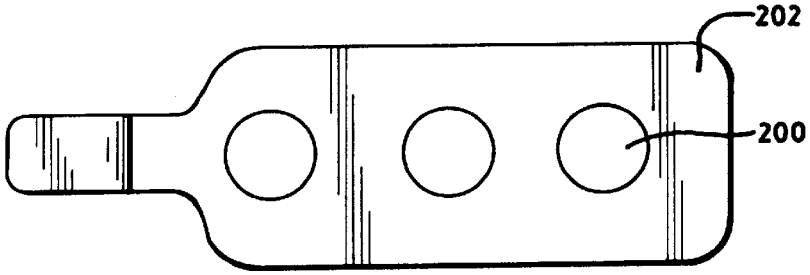
Figure 19:
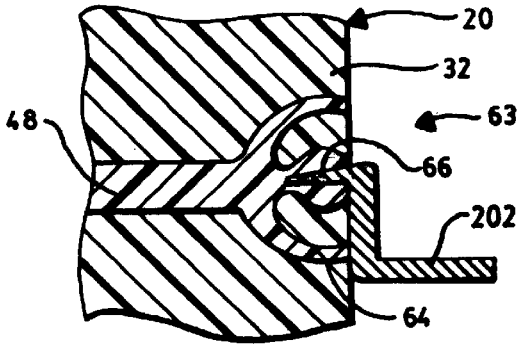
FIG. 19 is a sectional view of the brick/stone tie connected to a connector arm.

The modular wall form 22 can be covered on the outside with brick, stucco, stone facing, and wood. FIGS. 18A and 18B show a side and top view of a brick/stone tie 202. The brick/stone tie 202 has a plurality of holes 200 through which the mortar 196 for retaining the bricks 198 can pass therein making a solid connection between the mortar and brick and the brick/stone tie 202. The brick/stone tie 202 is connected to the modular form wall 22 by screwing the tie 202 into the spherical ball 66 of the connector arm 48, as seen in FIG. 19. With the brick/stone tie 202 installed to the modular form wall 22, the mason is able to build the brick/stone facing as is done in conventional walls.

Figure 27A:
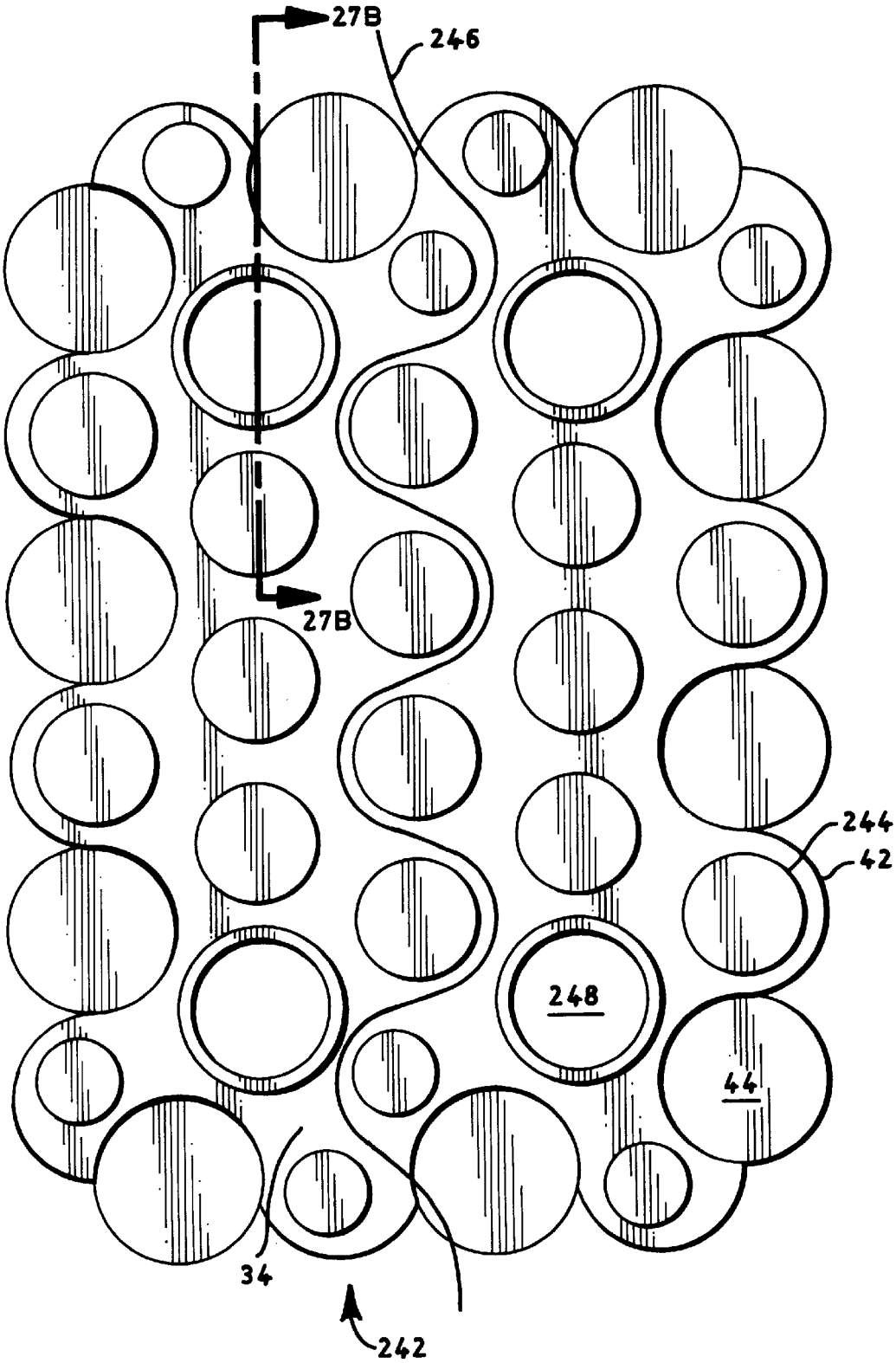
FIG. 27A is a side view of an alternative panel.
Figure 27B:
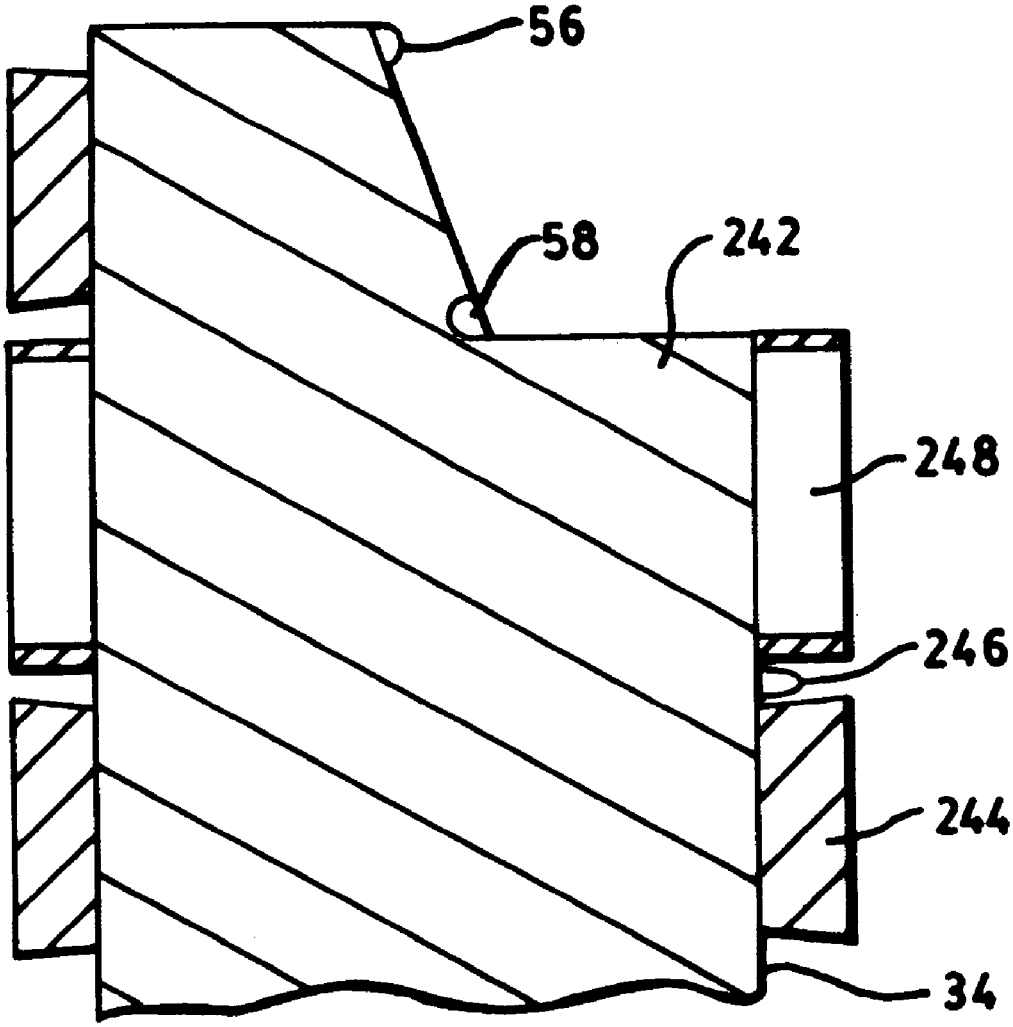
FIG. 27B is a sectional view taken along line 27B—27B of FIG. 27A.

If the desire is to stucco the outer surface, the texture of the outer planar wall 34 assists in the grabbing of the stucco to the modular form wall 22. A crosshatch texture 180 is shown in FIGS. 2 and 4. FIGS. 27A and 27B show an alternative texture on the outer planar wall 34 of a wall form panel 32.

Figure 20A:
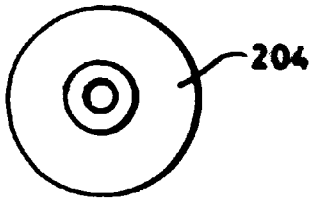
FIGS. 20A and 20B are a front and side view of a button lock.
Figure 20B:
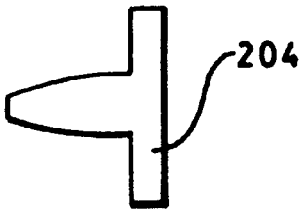

In addition, it may be desirable to place a plastic or wire mesh over the modular form wall 22 to facilitate stuccoing. FIGS. 20A and 20B show a front and side view of a button lock 204 which would hold the plastic or wire mesh against the outer planar wall 34 of the modular form wall 22. The button lock 204, similar to the brick/stone tie 202, is connected using the spherical ball 66 of the connecting arm 48.

For installing interior walls, the modular wall form 22 can be covered with conventional wallboard by placing strapping against the modular wall form 22. The strapping can be secured by driving screws into the spherical ball 66 of the connector arm 48.

Figure 21A:
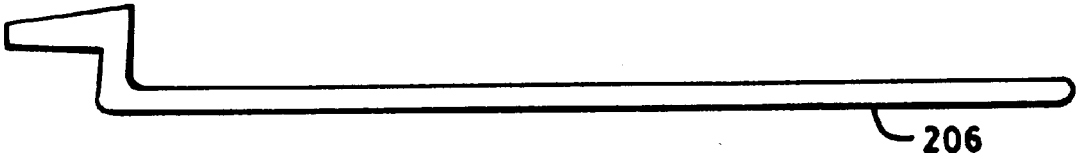
FIGS. 21A and 21B are a top and side view of a staging tie.
Figure 21B:
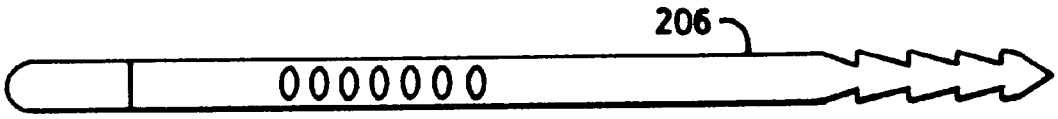

FIGS. 21A and 21B show a top and side view of a staging tie 206 which is secured to the connector arm 48. The staging tie 206 has a plastic strap portion with a plurality of teeth to be accepted by one of a plurality of slots. Upon being secured to the connector arm 48 of the wall form panel 32 of the modular concrete wall system 20, the staging tie 206 can secure staging/scaffolding by encircling a metal bar or similar portion of the staging tie, therein allowing further construction of the building where staging or scaffolding is required. The staging ties 206 will be removed from the wall form panel 32 or buried behind another surface such as masonry or stucco upon the final construction. The staging tie 206 would allow staging/scaffolding to be secured using the staging tie to facilitate construction of the building.

Figure 22A:
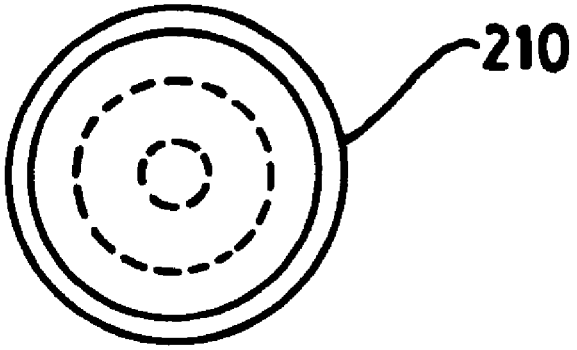
FIGS. 22A and 22B are a front and side view of a wall bracing tie cap.
Figure 22B:
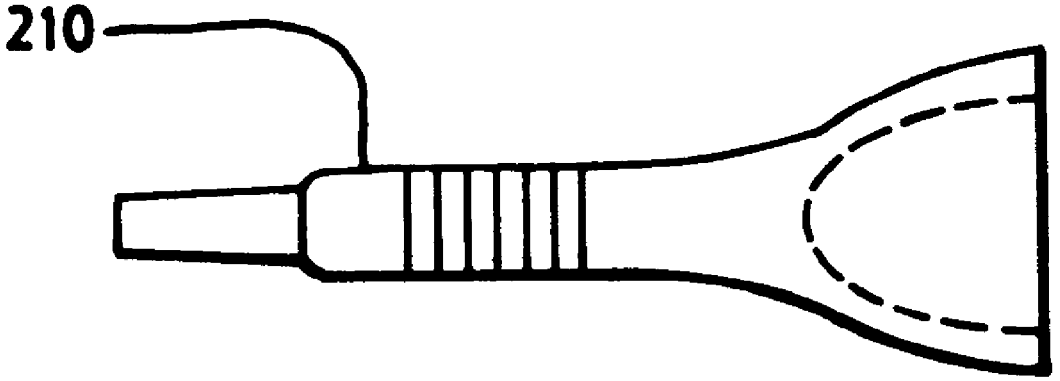

In addition, a front and a side view of a wall bracing tie bar 210 is shown in FIGS. 22A and 22B respectively. The wall bracing tie bar 210 would receive a reinforcement bar to help stiffen the modular concrete wall system 20 as the concrete is hardening. It is recognized that other connectors could be coupled to the connector arm 48.

Figure 23:
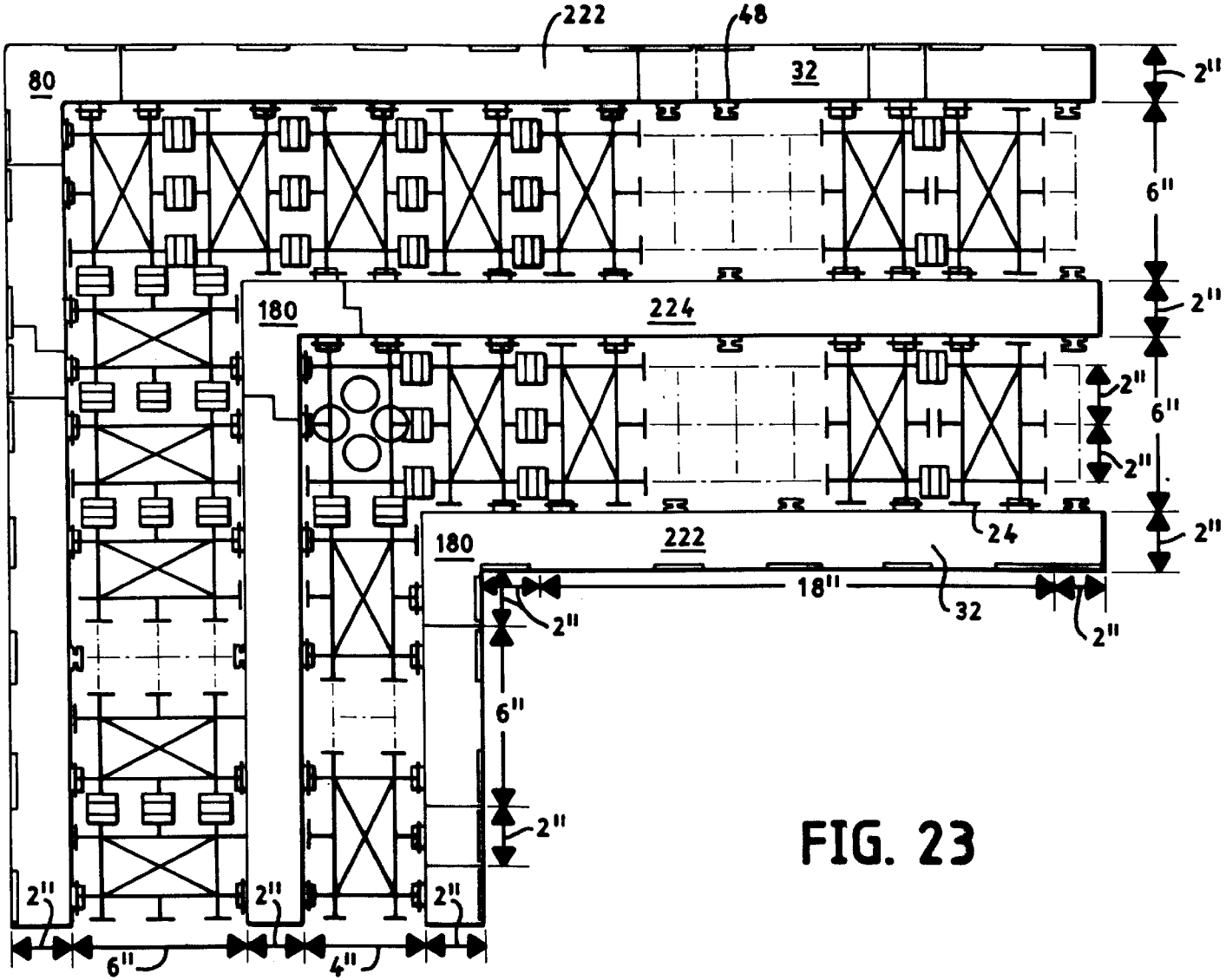
FIG. 23 is a schematic top view of a double wall.

FIG. 23 is a top view of a comer of the wall having a pair of outside modular wall forms 222 and an inner wall form 224. Interposed between each of the outer wall forms 222 and the single inner wall form 224 is a concrete layer. Similar to the method of building described above, the first course of wall form panels 32 are placed down on the ground with the structural tie plates 24 interposed. However, the inner wall form 224 has structural tie plates 24 extending out of it on both planar sides 34 to the adjacent outer modular wall forms 222. The entire modular form 22 is built with the wall forms 222 and 234 including and the vertical reinforcement bars 26 and horizontal reinforcement bars 28 are positioned as described above using the respective locking clamps 104 and 106. The concrete 30 is poured to make this sandwich construction. The structural tie plates 24 shown in FIG. 23 are an alternative tie plate. The tie plates 24 shown do not have a circular opening for reinforcement bars as shown in the previous embodiment or in the structural tie plates shown in FIGS. 24A and 24B as discussed below.

Figure 24A:
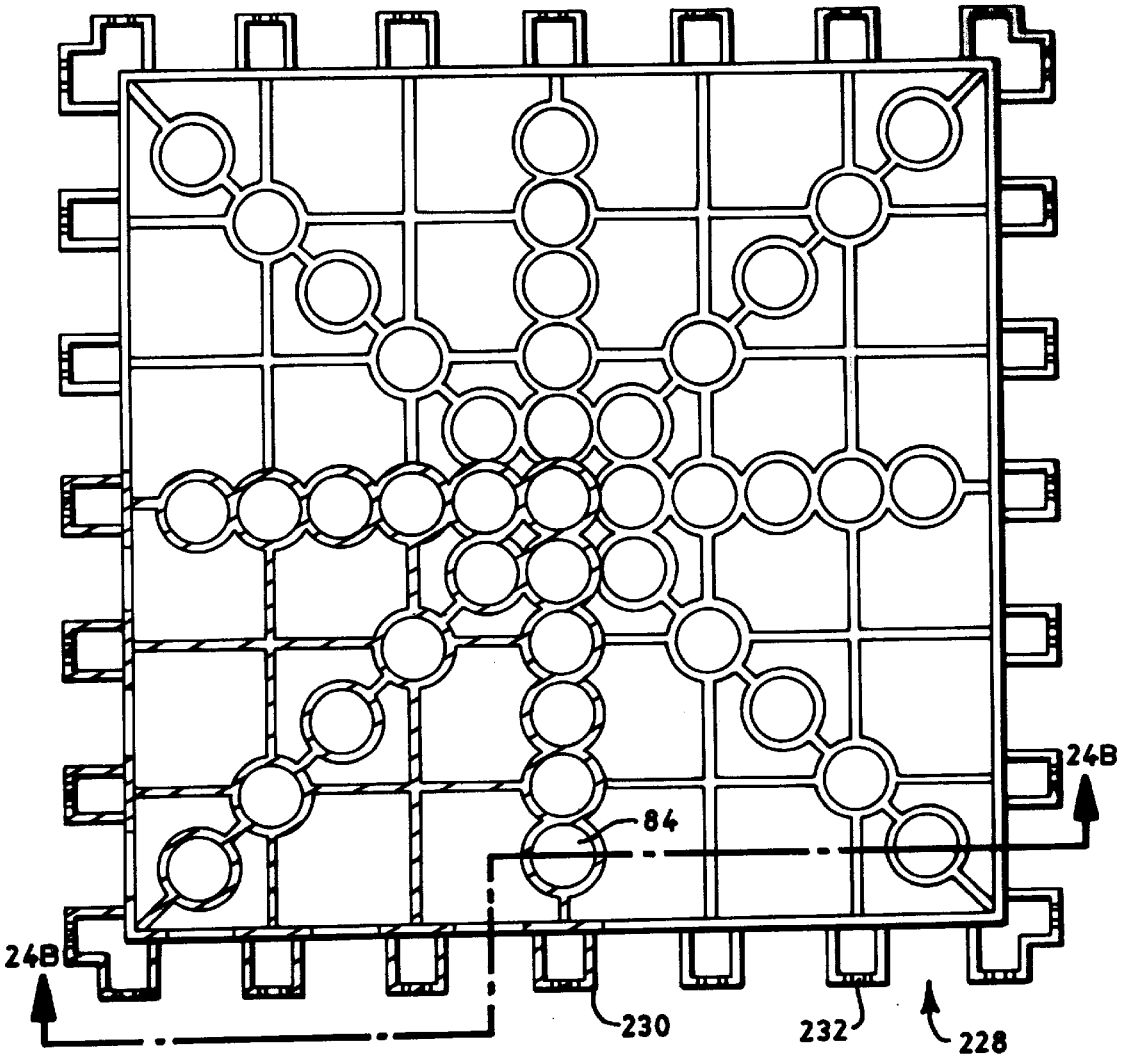
FIG. 24A is a top view of an alternative structural tie plate.
Figure 24B:
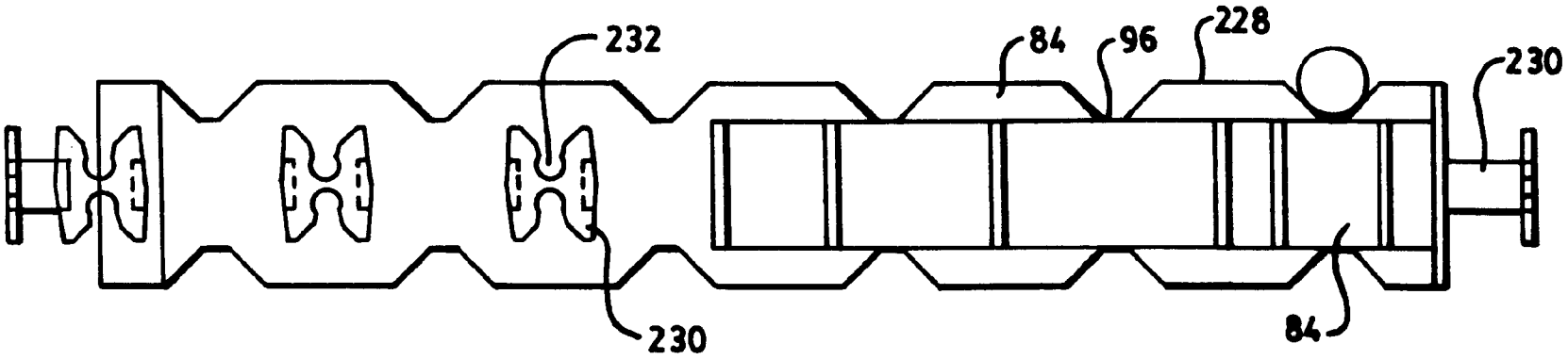
FIG. 24B is a side sectional view of an alternative tie plate taken along line 24B—24B in FIG. 24A.

An alternate structural tie plate 228 is shown in FIG. 24A. In contrast to the structural tie plate 24 shown in FIGS. 7A and 7B, this structural tie plate 228 has a tie plate connector 230 which is not received within the wall form panel 32 and thus uses a different connector arm 48 as described below. FIG. 24B is a side sectional view of this tie plate 228 taken along the line 24B—24B of FIG. 24A. The tie plate connector 230 has a groove which accepts a rod projecting from the outer planar wall 34 of the wall form panel 32. This rod is part of the connector arm 48. The circular opening 84 for the vertical reinforcement bars 26 are shown. In addition, a horizontal reinforcement bar 28 is shown in phantom.

Figure 25:
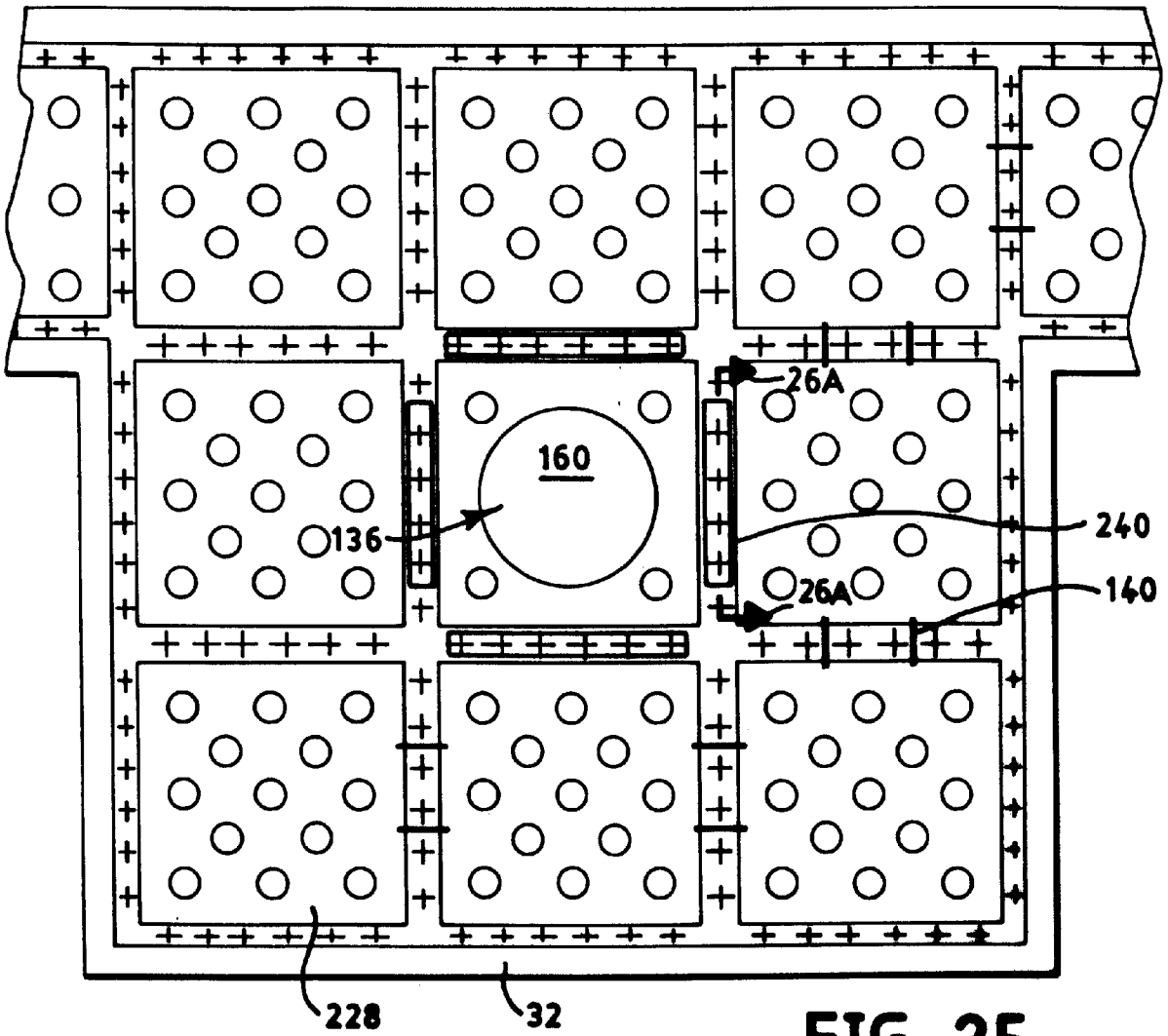
FIG. 25 is a top view of a plurality of structural tie plates linked together.
Figure 26B:
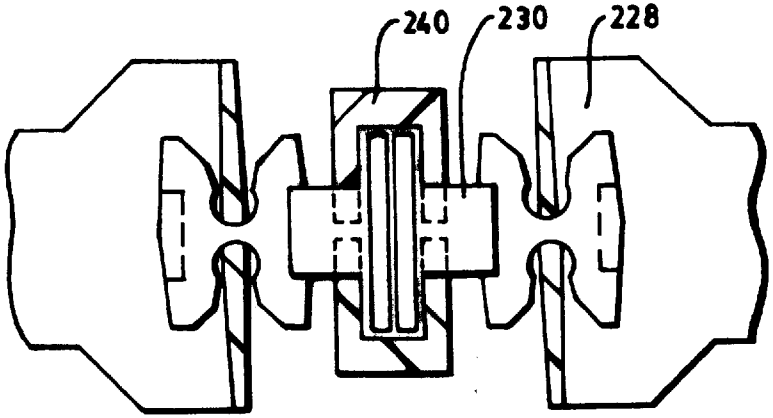
FIG. 26B is a side view of a column interlocking brace.
Figure 26A:
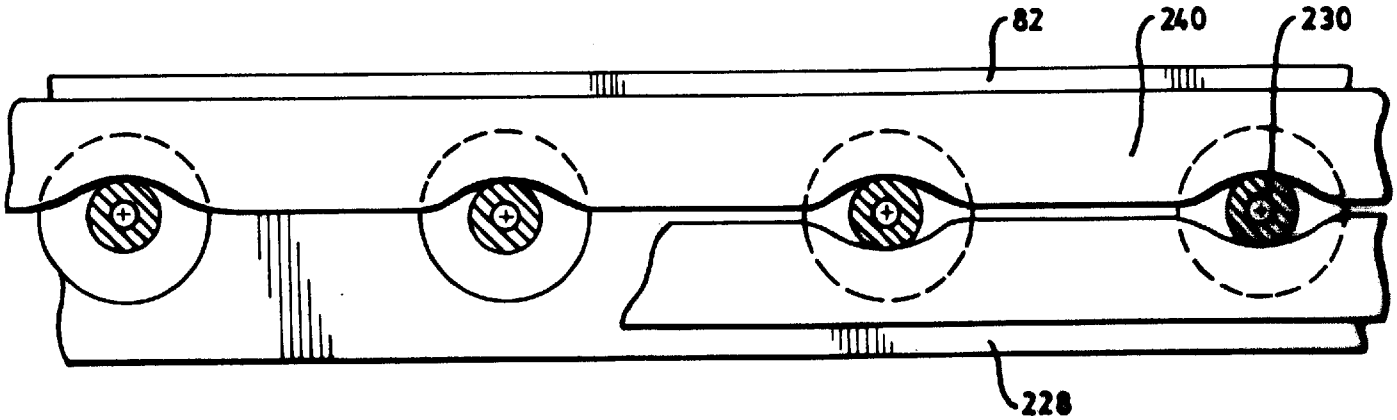
FIG. 26A is a sectional view of the multiple structural tie plates linked together taken along line 26A—26A of FIG. 25.

FIG. 25 is a schematic of a top view of a plurality of structural tie plates 24 or 228 linked together. In contrast to the FIGS. 15A and 15B, and FIGS. 16A and 16B, the structural pump tie plate 136 is not linked to any of the wall form panels 32. The structural pump tie plate 136 is located within an outer layer of structural tie plates 228. The structural tie plates 228, including the structural pump tie plate 136, are linked using a column interlocking brace 240 as shown in FIG. 26A. The column interlocking brace 240 locks the two structural tie plates 228 together. The structural tie plates 228 are placed adjacent to each other such that the tie plate connectors are engaging each other. The column interlocking brace 240 is positioned both above and below the tie plate connectors 230 and holds them in snug engagement as seen in FIG. 26B. The column interlocking brace 240 is shown schematically in FIG. 25 as a rectangular box surrounding and connecting the structural tie plates. The tie plate connector 140 as shown in FIG. 13C is used also between those structural tie plates that are secured by attachment to a modular wall form 32.

FIG. 27A is a side view of an alternative wall form panel 242. The wall form panel has a plurality of circular projections 244 forming a texture planar side 34. The circular projections 244 allow for better adherence for things such as stucco on the outside surface, as described above. In addition, the circular projections 244 allow for wires 246 to be run along the wall form panel. The wires 246 are laid between the circular projections and when cement is poured into the modular form 22, the circular projections 244 retain the wires in the proper position where the concrete pushes it securely against the outer planar wall 34 of the wall form panel 242. FIG. 27B is a sectional view showing the protrusions.

In a preferred embodiment, the textured projections 244 are larger diameter spaced from the planar wall 34 therein. When items such as concrete and stucco adhere there is a mechanical locking. In addition, the wire 246 is shown in phantom between the textured protrusion and the connector. It is known that the connector projects from beyond the surface of the wall form panel, as further described below.

Figure 28A:
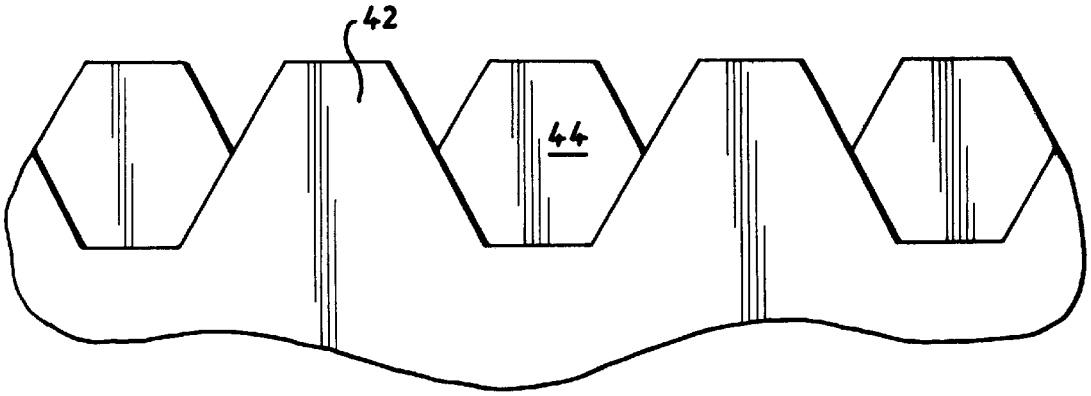
FIGS. 28A–28D are broken out sections of alternative views of teeth.
Figure 28B:
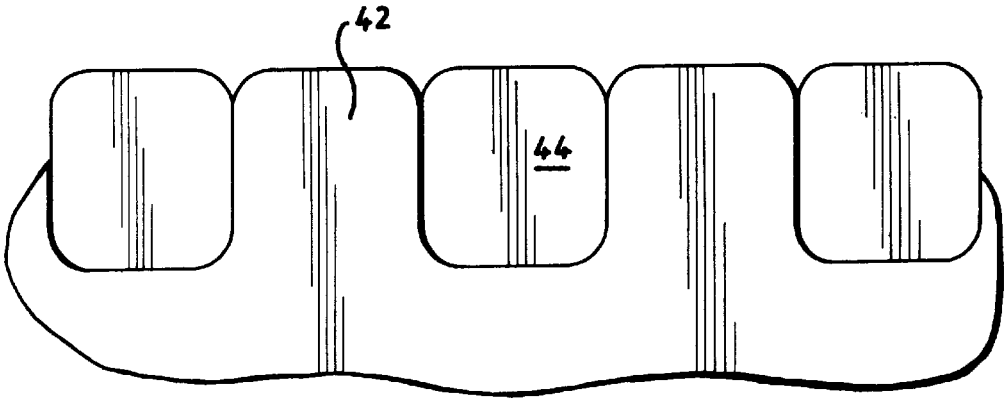
Figure 28C:
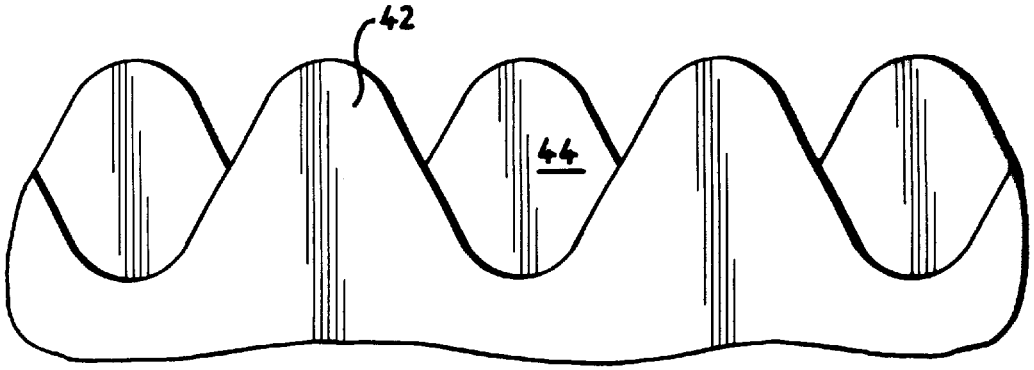
Figure 28D:
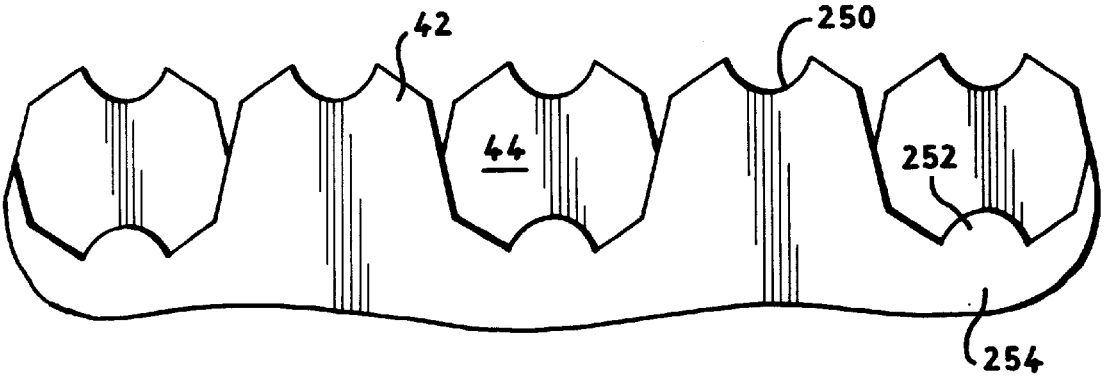

While in a preferred embodiment, the teeth 42 are formed of semicircles, it is recognized that the teeth could have other shapes. FIG. 28A shows the teeth having a polygon shape. FIG. 28B shows the teeth having a square shape. FIG. 28C shows the teeth having a sinusoidal or saw-tooth shape. The teeth in FIG. 28D have a multi-faced wall with a dimple or groove 250 at the top and a protrusion 252 at the root 254 of the void.

Figure 29:
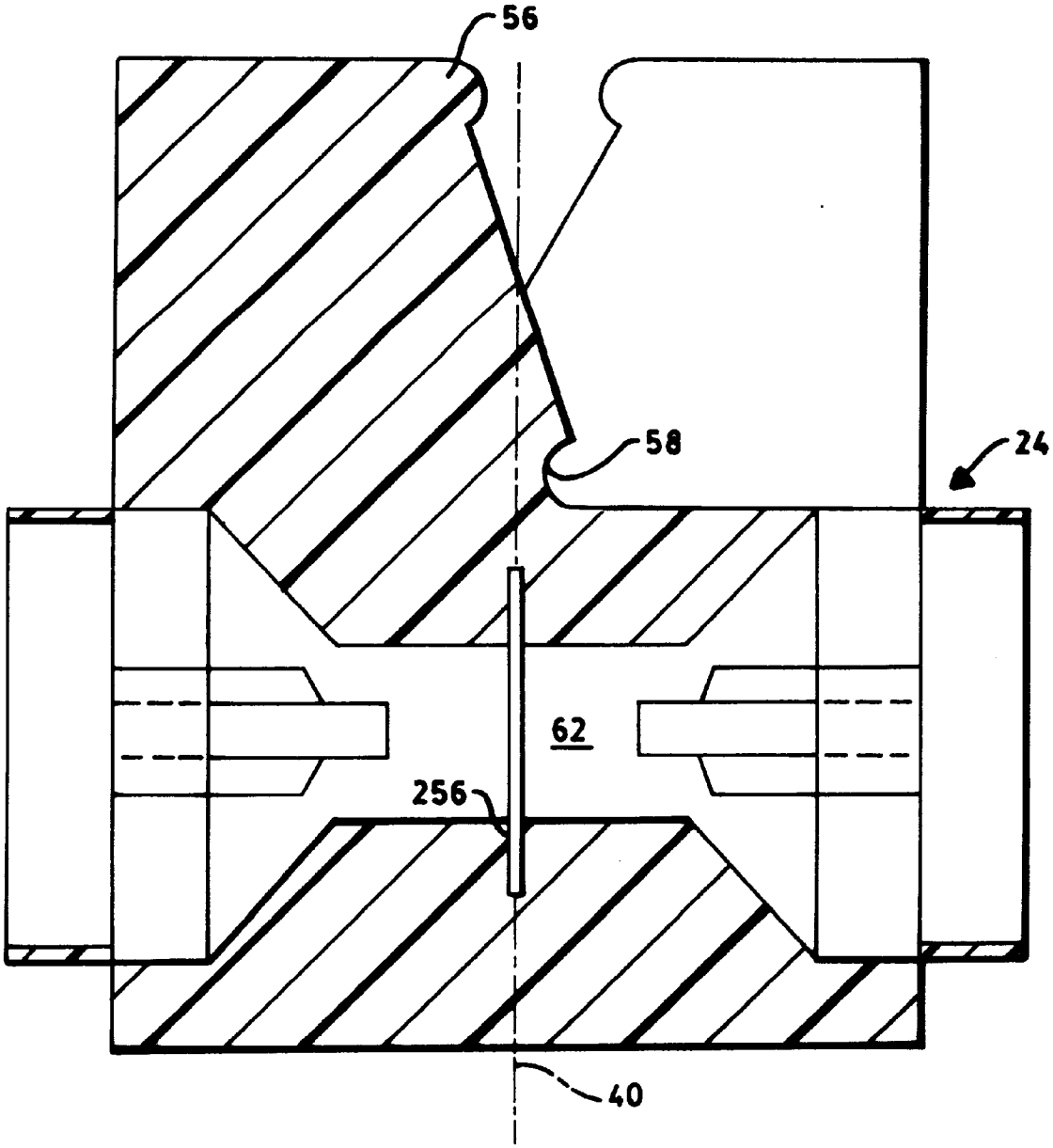
FIG. 29 is a sectional view of an alternative connector.

FIG. 29 is a sectional view of an alternative connector arm 248. This connector arm protrudes from the outer planar wall 34. In addition, it has an additional rib 256 located along the rod 62 to distribute strain against the connector arm by means of additional contacts with the EPS. The connector arm 48 or 248 can be formed of numerous alternative embodiments such as the one shown in FIG. 5 wherein the structural tie plate 24 protrudes into the wall form panel 32 or wherein the connector arm 260 projects out of the wall form panel as shown schematically in FIG. 23 and FIG. 29.

Figure 30A:
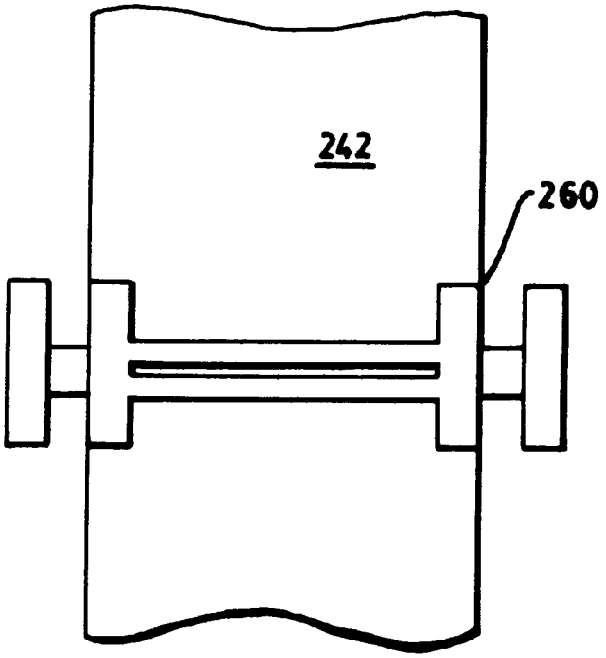
FIGS. 30A and 30B are schematic sectional views of alternative connectors.
Figure 30B:
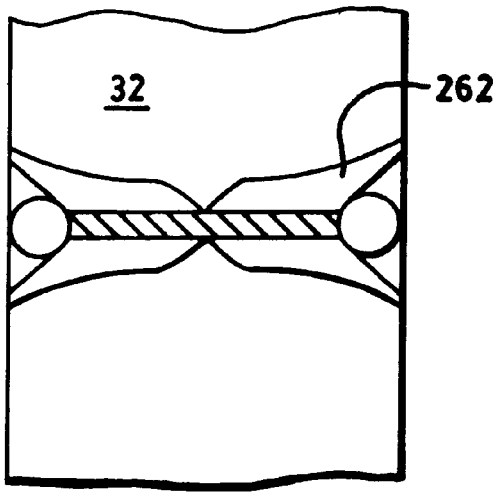

FIGS. 30A and 30B show alternative connector arms within the wall form panel 32/242. The connector arm 260 of FIG. 30A is for structural tie plates 228, shown in FIGS. 24A and 24B. The connector arm 262 shown in FIG. 30B is for use with a structural tie plate 24 similar to that disclosed above in FIGS. 7A and 7B. The connector arm 262 shown however is of a form that can be inserted as two parts in the all form panel 32 after the wall form panel 32 is formed by screwing the two parts of he connector arm 262 together from either side.

Figure 31:
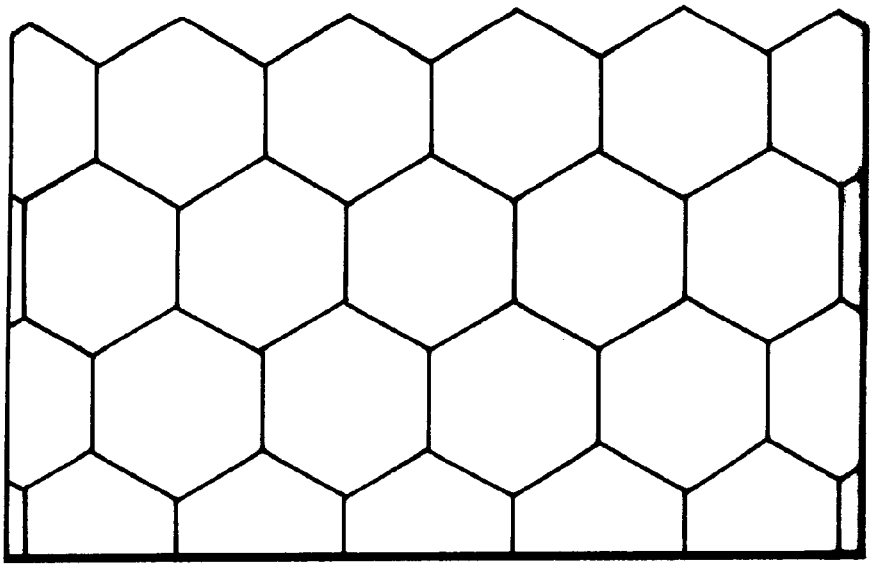
FIG. 31 is a side view of an alternative panel.

While the four-edge wall form panel 32 is a preferred embodiment, it is recognized that multiple edges, such as six, with a variety of interlocking protrusions could be used. In an alternative embodiment of the wall form panel shown in FIG. 31, he plurality of panels each have six edges.

Figure 32A:
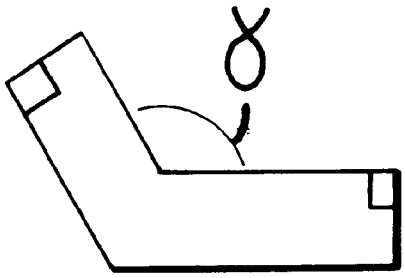
FIGS. 32A and 32B are schematic top views of corners.
Figure 32B:
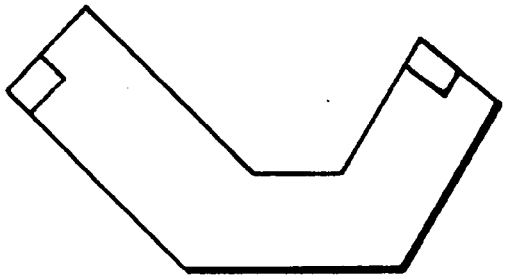
Figure 33B:
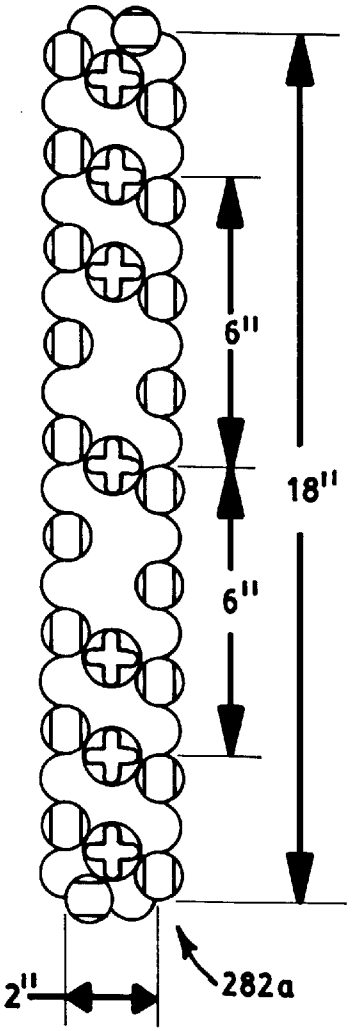
FIGS. 33A–33D are schematic side views of alternative panels.
Figure 33A:
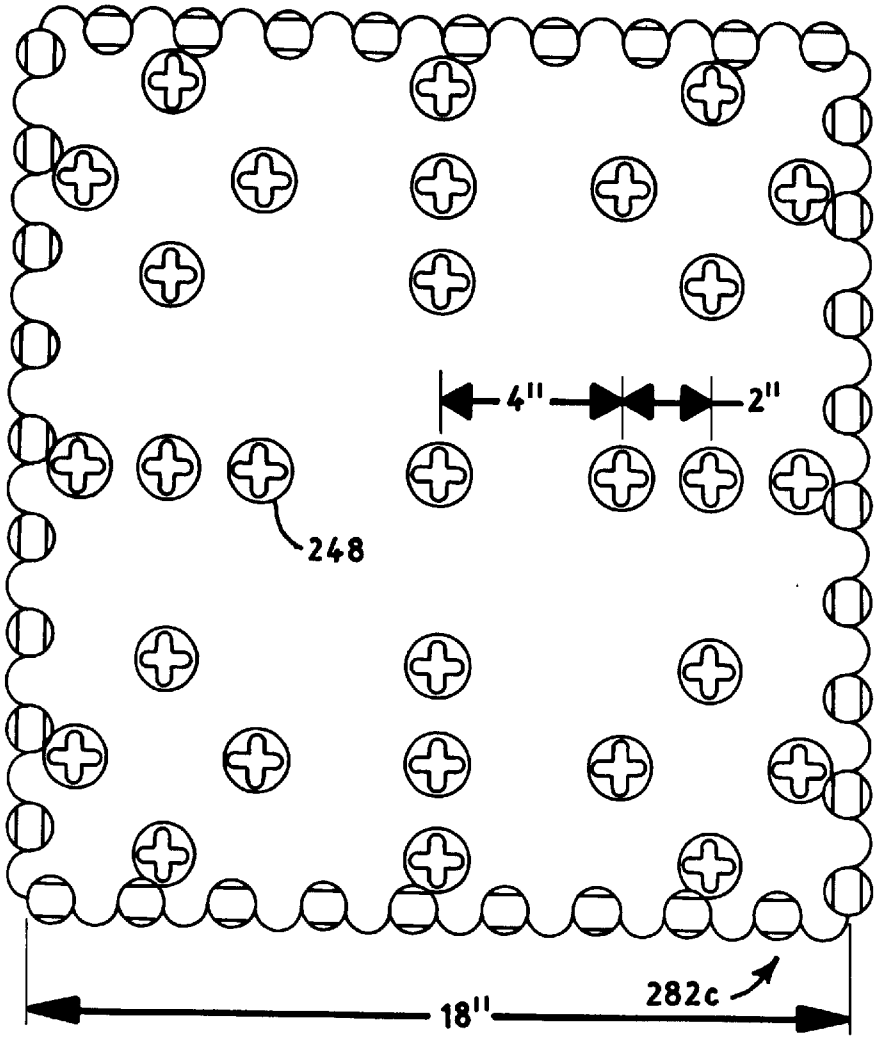
Figure 33C:
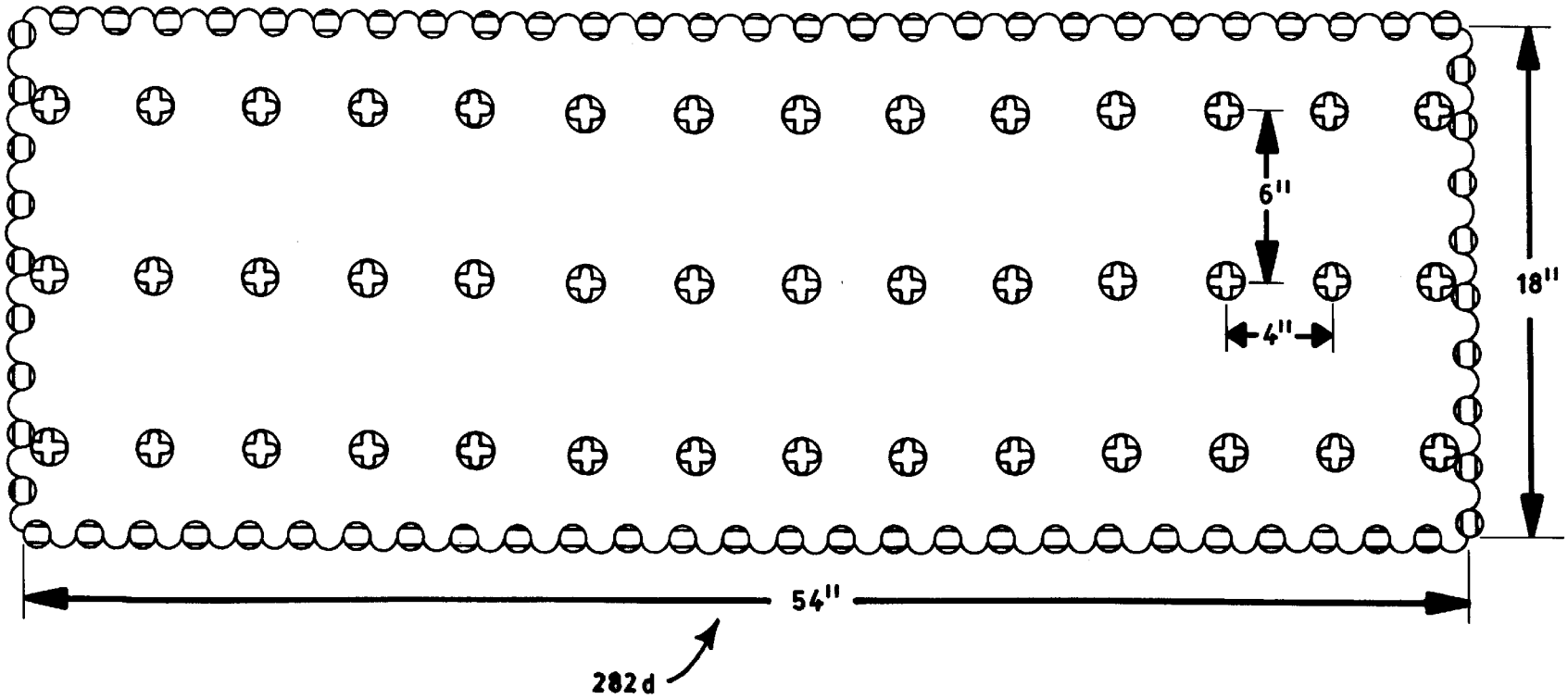

While the previous embodiment shows comer forms having the side edges at 90°, it recognized that the side edges could be at different angle γ. As seen in FIG. 32A, the side edges of the comer form is at an angle γ of 1200. The corner form of FIG. 32B has a planar section between the two planar sections which have the interlocking protrusions on the sides. All planar sections would have interlocking protrusions on the top and bottom.

Figure 34:
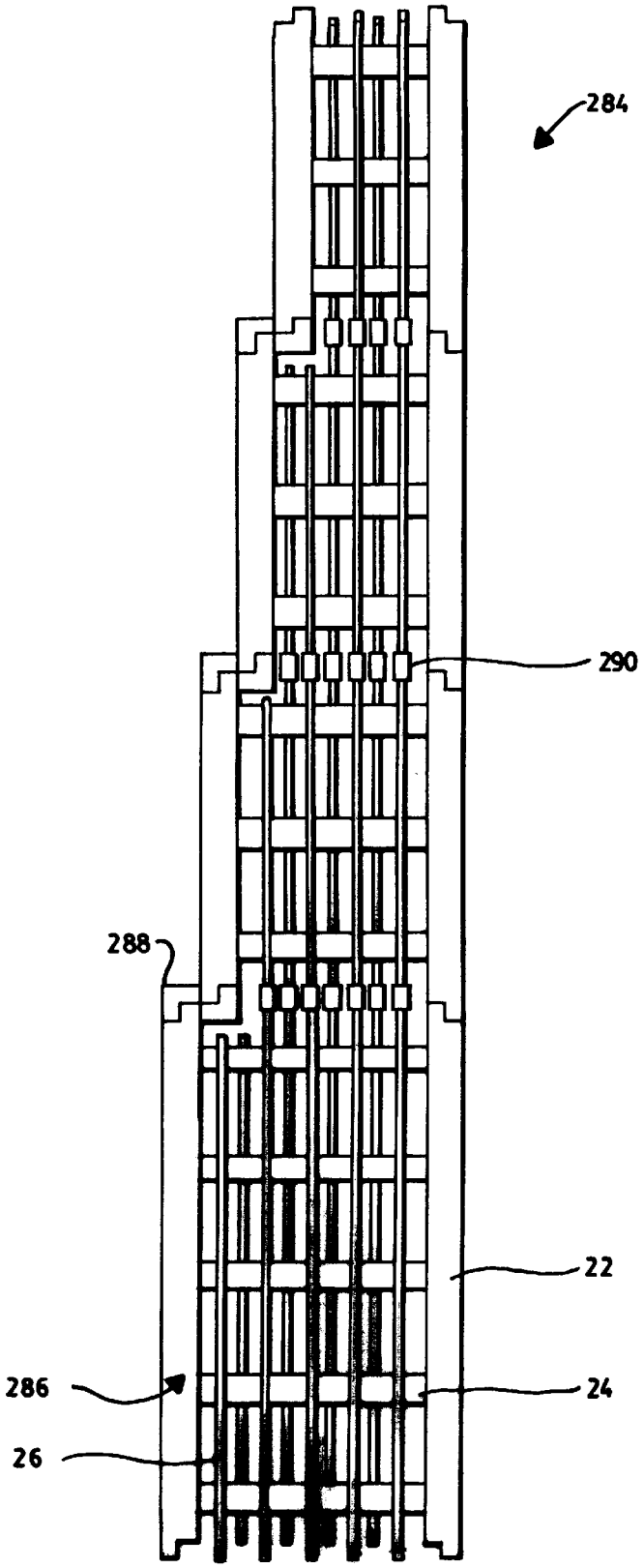
FIG. 34 is a sectional view of a multi-tiered wall.

FIGS. 33A through 33D show alternative wall form panels 282. The wall form panels 282 have a different configuration of the connector arms 248. In this embodiment, the connector arms on shorter panels, such as the two inch in length panel 282*a*, and the six inch in length panel 282*b*, are spaced two inches apart near the edges of the panel and four inches apart elsewhere. In addition, the connector arms 248 are spaced six inches vertically in most portions, such as in the 54 inch panel 282*d*. The connector arms 248 shown in FIGS. 33A through 33D are similar to that shown in FIGS. 29. FIG. 34 shows a multi-tier stepped wall 284. The wall has a modular form wall 22 which extends planarly upward. An inner wall 286 steps inward as it increases in height. The modular wall system 20 has a stepping form 288 which steps the modular wall form 22 inward. The modular wall system 20 has structural tie plates 24 and reinforcement bars 26 that extend vertically are shown.

Figure 35B:
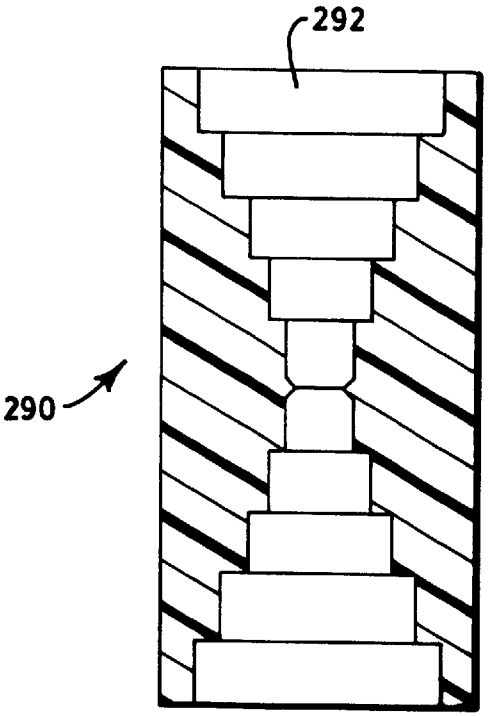
FIGS. 35A and 35B are a top and side view of vertical rebar connector.
Figure 35A:
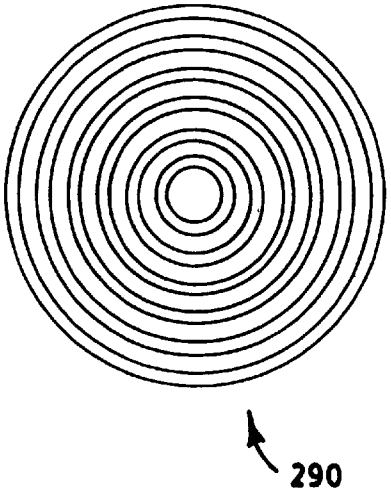
Figure 33D:
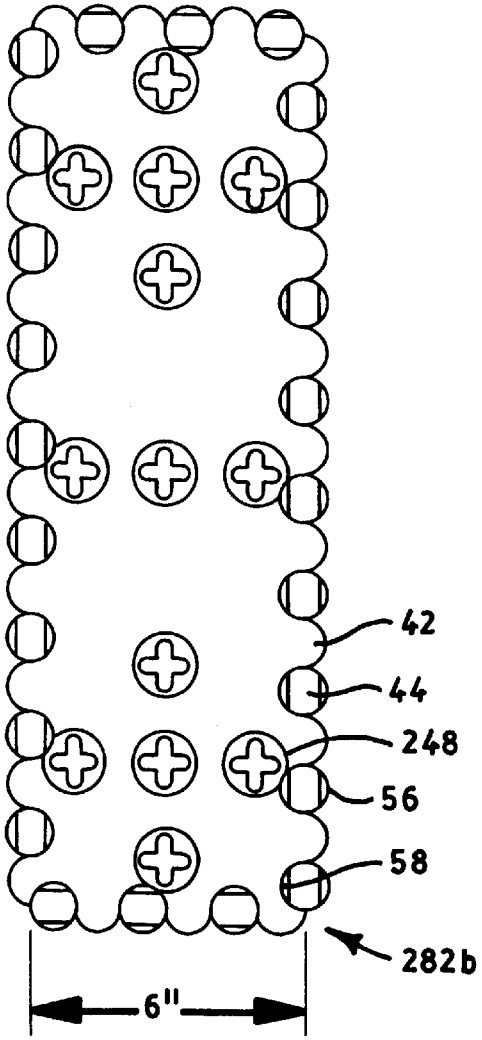

Referring to FIGS. 35A and 35B the vertical reinforcement bars 26 can be connected using a vertical reinforcement bar union tie 290 that has a staggered step 292 to receive multiple diameter reinforcement bar 26.

The modularity and reversibility of the wall form panels in conjunction with the positioning of a connector arm ensures that the concrete wall system 20 is aligned and properly rigid. A single user could upon initial alignment build the whole concrete wall system 20 to allow for the pouring of the concrete. The wall form panels 32 being formed of an EPS material in addition add insulation to the building.

While this invention has been particularly shown and described with references to preferred embodiments thereof, it will be understood by those skilled in the art that various changes in form and details may be made therein without departing from the spirit and scope of the invention as defined by the appended claims.

With the wall system 20 being used above ground, the installation of door and window openings is desirable prior to pouring the concrete 30. The rough opening of the door or window is built out and the wall form panels 32 are built around them. In the alternative, a rough out form can be installed between the wall form panels of the two modular form walls 22 to create a space wherein concrete will not be poured.

It is recognized that in addition bay windows may be roughed in. The bay windows would be roughed in by setting in in the same manner as traditional roughed in concrete as described in the preceding paragraph. The rough-in opening will rest upon structural tie plates with rebar.

It is recognized that an alternative could be to have wall form panels have the required connecting arms on only one side and the other side could have an imitated wood siding texture or shingle texture that could be painted or covered with a thin coat of plaster or stucco. While in a preferred embodiment the EPS has a uniform density, it is recognized that the density could vary such that the surfaces could have a denser surface than the interior or vice versa. While EPS is a preferred material, it is recognized that other materials such as pressed fiber board, hard plastic, tile or a metal can create the wall form panels. In addition to EPS, other similar materials may be expanded polypropylene (EPP), as well as co-polymers such as GECET sold by GE Plastics. The preferred embodiment of EPS is a modified EPS which would increase flame retardance.

What is claimed is:

1. A panel for a form system comprising:

a body having a circumference;

the body having a pair of planar sides;

defining a center plane interposed between the planar sides;

a plurality of connected edges defining the circumference, all of the edges having a plurality of equally spaced substantially identical protrusions defining at least one tooth and one void on each edge of each side of the center plane, the protrusions are staggered about the center plane, such that a tooth on one side of the center plane aligns with a void on the other side of the center plane.

2. The panel of claim 1 wherein each tooth has a projection and each void has a groove, the projection and groove adapted for interlocking with a complementary groove and projection of another panel.

3. The panel of claim 1 further comprising a plurality of connection points on the planar sides.

4. The panel of claim 3 wherein the connection points are within the planar sides.

5. The panel of claim 3 wherein the connection points project from the planar sides.

6. The panel of claim 1 wherein the teeth of the protrusions are semicircular shaped.

7. The panel of claim 1 wherein the teeth of the protrusions are sinusoidal shaped.

8. The panel of claim 1 wherein the teeth of the protrusion are square-wave shaped.

9. The panel of claim 1 wherein each edge has a length defined by $1=xy^n$, where x is a positive number, y is an integer between 2 and 6, inclusive, and n is an integer between 0 and 7, inclusive.

10. The panel of claim 9 wherein y is 3 and x is 2.

11. The panel of claim 1 wherein the panel has four edges.

12. The panel of claim 1 wherein the panel has six edges.

13. A panel for a form system comprising:

a body having a circumference;

the body having a pair of planar sides;

defining a center plane interposed between the planar sides;

a plurality of connected edges defining the circumference, all of the edges having a plurality of equally spaced substantially identical protrusions defining at least one tooth and one void on each edge, the protrusions are staggered such that a tooth on one side of the center plane aligns with a void on the other side of the center plane and each side of the center plane has a tooth at one end and a void at the other end such that the panel is rotationally symmetric about an axis extending from one planar side to the other.

14. A panel system comprising a plurality of panels;

each panel having a body having a circumference;

the body having a pair of planar sides;

defining a center plane interposed between the planar sides; and a plurality of connected edges defining the circumference, all of the edges having a plurality of equally spaced substantially identical protrusions defining at least one tooth and one void on each edge on each side of the center plane, the protrusions are staggered about the center plane, such that a tooth on one side of the center plane aligns with a void on the other side of the center plane;

each edge having a length defined by $1=xy^n$ wherein x is a positive number, y is an integer between 2 and 6, inclusive, and n is an integer between 0 and 7, inclusive; and the protrusions of the panels intermeshed to form a wall form.

15. The panel system of claim 14 wherein x=2 and y=3.

16. The panel system of claim 14 further comprising a corner panel having a body having at least two pairs of planar sides, each of the sides having a circumference, the sides attached at the circumference to form an angle therebetween, a plurality of connected edges defining the unattached portion of the circumference, the edges having a plurality of equally spaced protrusions defining a tooth and a void on each edge on each side of the center plane, the protrusions are staggered about the center plane, such that a tooth on one side of the center plane aligns with a void on the other side of the center plane.

17. The panel system of claim 16 further comprising a footing having at least one panel having a pair of generally parallel walls, each wall having a pair of planar sides defining a center plane interposed between the planar sides, each of the sides having a top edge, a bottom edge and a pair of side edges, the top and side edges having a plurality of equally spaced protrusions defining a tooth and a void on each edge on each side of the center plane, the protrusions are staggered about the center plane, such that a tooth on one side of the center plane aligns with a void on the other side of the center plane, the generally parallel walls are curved such that the side edges are curved and the top edge is in a plane parallel to and spaced from the plane of the bottom edge.

18. The panel system of claim 16 wherein each side of the center plane has a tooth at one end and a void at the other end such that the panel is rotationally symmetric about an axis extending from one planar side to the other.

19. The panel system of claim 16 wherein the pairs of planar sides form a corner with an angle of 90°.

20. The panel system of claim 16 wherein the pairs of planar sides form a corner with an angle of 120°.

21. The panel system of claim 16 wherein the pairs of planar sides form a corner with an angle of 135°.

22. A form comprising:

a pair of panels having a body having a circumference;

the body having a pair of planar sides;

defining a center plane interposed between the planar sides; and a plurality of connected edges defining the circumference, all of the edges having a plurality of equally spaced substantially identical protrusions defining at least one tooth and one void on each edge on each side of the center plane, the protrusions are staggered about the center plane, such that a tooth on one side of the center plane aligns with a void on the other side of the center plane;

a plurality of connectors carried by the panels; and a structural tie plate connects with the connectors for aligning and positioning the panels with respect to other panels.

23. The form of claim 22 wherein the connector has a rod extending through the panel with a connector having a hemispherical dome portion at the end of the rod and a spherical ball located within the hemispherical dome for attaching to the structural tie plate.

24. The form of claim 22 wherein the connector has a rod extending through the panel with a pair of circular disks engaging the edge of the panel and a second pair of circular disks spaced from one of the first pair of circular disks.

25. A modular wall system comprising:

a pair of panels having a body having a circumference;

the body having a pair of planar sides;

defining a center plane interposed between the planar sides; and a plurality of connected edges defining the circumference, all of the edges having a plurality of equally spaced substantially identical protrusions defining at least one tooth and one void on each edge on each side of the center plane, the protrusions are staggered about the center plane, such that a tooth on one side of the center plane aligns with a void on the other side of the center plane;

a plurality of connectors carried by the panels;

a structural tie plate connects with the connectors for aligning and positioning the panel; and concrete for and encasing the structural tie plates.

26. The modular wall system of claim 25 further comprising a plurality of reinforcement bars extending between the structural tie plates and connected to the structural tie plates by reinforcement locking bars, the reinforcement bars for stiffening the modular wall system.

27. The modular wall system of claim 26 further comprising a corner panel having a body having at least two pairs of planar sides, each of the sides having a circumference, the sides attached at the circumference to form an angle therebetween, a plurality of connected edges defining the unattached portion of the circumference, the edges having a plurality of equally spaced protrusions defining a tooth and a void on each edge on each side of the center plane, the protrusions are staggered about the center plane, such that a tooth on one side of the center plane aligns with a void on the other side of the center plane.

28. The modular wall system of claim 27 wherein each edge has a length defined by $1=xy^n$ where x is a positive number, y is an integer between 2 and 6, inclusive, and n is an integer between 0 and 7, inclusive.

29. The panel system of claim 28 further comprising a footing having at least one panel having a pair of generally parallel walls, each wall having a pair of planar sides defining a center plane interposed between the planar sides, each of the sides having a top edge, a bottom edge and a pair of side edges, the top and side edges having a plurality of equally spaced protrusions defining a tooth and a void on each edge on each side of the center plane, the protrusions are staggered about the center plane, such that a tooth on one side of the center plane aligns with a void on the other side of the center plane, the generally parallel walls are curved such that the side edges are curved and the top edge is in a plane parallel to and spaced from the plane of the bottom edge.

30. The modular wall system of claim 28 further comprising a heat cap having at least one of the panels and at least a pair of corner forms for retaining both heat and moisture to effect proper concrete curing conditions.

31. The modular wall system of claim 28 further comprising at least one attachment carried by the connector for securing brick to the panel.

32. The modular wall system of claim 27 wherein the panel has a texture for securing an outer coat.

33. A modular wall system comprising:

a pair of panels having a body having a circumference;

the body having a pair of planar sides;

defining a center plane interposed between the planar sides; and a plurality of connected edges defining the circumference, all of the edges having a plurality of equally spaced substantially identical protrusions defining at least one tooth and one void on each edge, the protrusions staggered such that a tooth on one side of the center plane aligns with a void on the other side of the center plane;

each edge has a length defined by $1=xy^n$ where x is a positive number, y is an integer between 2 and 6, inclusive, and n is an integer between 0 and 7, inclusive;

a plurality of connectors carried by the panels;

a structural tie plate connects with the connectors for aligning and positioning the panel; and concrete for and encasing the structural tie plates.

34. The modular wall system of claim 33 wherein y is 3.

35. The modular wall system of claim 34 wherein x is 2.

36. The modular wall system of claim 33 wherein each side of the center plane has a tooth at one end and a void at the other end such that the panel is rotationally symmetric about an axis extending from one planar side to the other.

37. A method of creating a modular wall form comprising the following steps:

providing a plurality of panels each having a body having a circumference;

the body having a pair of planar sides;

defining a center plane interposed between the planar sides; and a plurality of connected edges defining the circumference, all of the edges having a plurality of equally spaced substantially identical protrusions defining at least one tooth and one void on each edge or each side of the center plane, the protrusions are staggered about the center plane, such that a tooth on one side of the center plane aligns with a void on the other side of the center plane;

selecting a first panel of a desired height and a desired length;

connecting a second panel of the desired height and of a desired length to the first panel by connecting the protrusions to form the modular wall; and continuing to select and connect panels to the modular wall until a desired wall is built.

38. The method of creating a modular wall form of claim 37 wherein each edge has a length defined by $1=xy^n$ where x is a positive number, y is an integer between 2 and 6, inclusive, and n is an integer between 0 and 7, inclusive.

39. The method of claim 38 wherein y is 3.

40. The method of claim 39 wherein x is 2.

41. The method of claim 38 wherein each tooth has a projection and a groove adapted for interlocking with a complementary groove and projection on another panel.

42. The method of claim 41 wherein each side of the center plane has a tooth at one end and a void at the other end such that the panel is rotationally symmetric about an axis extending from one planar side to the other.

43. A method of creating a modular wall system comprising the following steps:

providing a plurality of panels each having a body having a circumference;

the body having a pair of planar sides;

defining a center plane interposed between the planar sides;

a plurality of connected edges defining the circumference, all of the edges having a plurality of equally spaced substantially identical protrusions defining at least one tooth and one void on each edge or each side of the center plane, the protrusions are staggered about the center plane, such that a tooth on one side of the center plane aligns with a void on the other side of the center plane; and a plurality of connectors carried by the panel; selecting a first panel of a desired height and a desired length;

connecting a second panel of the desired height and of a desired length to the first panel by connecting the protrusions to form a first course of a first modular wall;

continuing to select and connect panels to the first course of the first modular wall to produce;

connecting a plurality of panels to form a first course of a second modular wall;

connecting the first modular wall to the second modular wall with a plurality of structural tie plates locking with the connectors of the panels for spacing and positioning the modular walls; and pouring concrete between the modular walls.

44. The method of claim 43 wherein the teeth of the protrusions are sinusoidal shaped.

45. The method of claim 43 wherein the teeth of the protrusions are semicircular shaped.

46. The method of claim 43 wherein each edge has a length defined by $1=xy^n$ where x is a positive number, y is an integer between 2 and 6, inclusive, and n is an integer between 0 and 7, inclusive.

47. The method of claim 46 wherein y is 3.

48. The method of claim 47 wherein each side of the center plane has a tooth at one end and a void at the other end such that the panel is reversible.

49. The method of claim 48 further comprising a corner panel having a body having at least two pairs of planar sides, each pair having an associated top edge, a bottom edge and a side edge, the edges having a plurality of equally spaced protrusions defining a tooth and a void on each edge on each side of the center plane, the protrusions are staggered about the center plane, such that a tooth on one side of the center plane aligns with a void on the other side of the center plane.

50. The method of claim 49 further comprising the steps of:

providing a footing having at least one panel having a pair of generally parallel walls, a top edge, a bottom edge and a pair of side edges, the generally parallel walls are curved such that the side edges are curved and the top edge is a plane parallel to and spaced from the plane of the bottom edge.

51. The method of claim 50 wherein the connector has a rod extending through the panel with a pair of hemispherical dome portions at the end of the rod which secure and prevent lateral motion of the rod within the panel and a pair of spherical balls located within the hemispherical dome for attaching to the structural tie plate.

52. The method of clam 43 further comprising the steps of:

installing a plurality of horizontal reinforcement bars on top of the structural tie plates;

connecting the horizontal reinforcement bars to the structural tie plates by a reinforcement locking bar, the reinforcement bar for stiffening the modular wall system.

53. The method of claim 52 further comprising the following steps prior to the pouring of concrete between the modular walls:

adding a plurality of courses to the first modular wall; and adding a plurality of courses to the second modular wall.

54. The method of claim 53 further comprising the steps of:

installing a plurality of vertical reinforcement bars through openings in the structural tie plates; and connecting the vertical reinforcement bars to the structural tie plates by a reinforcement locking bar, the reinforcement bar for stiffening the modular wall system.

* * * * *